US005110713A

United States Patent [19]

Yoshida et al.

[11] Patent Number: 5,110,713

[45] Date of Patent: * May 5, 1992

[54] METHOD FOR PROCESSING SILVER HALIDE COLOR PHOTOGRAPHIC MATERIAL

[75] Inventors: Kazuaki Yoshida; Takatoshi Ishikawa, both of Minami-ashigara, Japan

[73] Assignee: Fuji Photo Film Co., Ltd., Kanagawa, Japan

[ * ] Notice: The portion of the term of this patent subsequent to Dec. 31, 2008 has been disclaimed.

[21] Appl. No.: 676,475

[22] Filed: Mar. 27, 1991

Related U.S. Application Data

[63] Continuation of Ser. No. 264,245, Oct. 28, 1988, abandoned.

[30] Foreign Application Priority Data

Oct. 30, 1987 [JP] Japan ..... 62-274845

[51] Int. Cl.[5] ..... G03C 7/30

[52] U.S. Cl. ..... 430/372; 430/376; 430/380; 430/382; 430/399; 430/468; 430/469; 430/490; 430/963

[58] Field of Search ..... 430/376, 372, 380, 399, 430/468, 469, 490, 489, 963, 382

[56] References Cited

U.S. PATENT DOCUMENTS

| | | | |
|---|---|---|---|
| 4,774,167 | 9/1988 | Koshimizu et al. | 430/380 |
| 4,797,351 | 1/1989 | Ishikawa et al. | 430/387 |
| 4,798,783 | 1/1989 | Ishikawa et al. | 430/380 |
| 4,800,153 | 1/1989 | Morimoto et al. | 430/380 |
| 4,801,512 | 1/1989 | Ohki et al. | 430/382 |
| 4,801,516 | 1/1989 | Ishikawa et al. | 430/435 |
| 4,818,673 | 4/1989 | Ueda et al. | 430/502 |
| 4,833,068 | 5/1989 | Ohki et al. | 430/484 |
| 4,876,174 | 10/1989 | Ishikawa et al. | 430/380 |
| 4,892,804 | 1/1990 | Vincent et al. | 430/380 |

FOREIGN PATENT DOCUMENTS

| | | | |
|---|---|---|---|
| 1373861 | 8/1964 | European Pat. Off. . | |
| 0029722 | 6/1981 | European Pat. Off. . | |
| 0032456 | 7/1981 | European Pat. Off. . | |
| 0211437 | 2/1987 | European Pat. Off. . | |
| 211437 | 2/1987 | European Pat. Off. . | |
| 29461 | 8/1974 | Japan . | |
| 52058 | 4/1980 | Japan . | |
| 200037 | 12/1982 | Japan . | |
| 31334 | 2/1983 | Japan . | |
| 42045 | 3/1983 | Japan . | |
| 50536 | 3/1983 | Japan . | |
| 48755 | 3/1984 | Japan . | |
| 174836 | 10/1984 | Japan . | |
| 177553 | 10/1984 | Japan . | |
| 177554 | 10/1984 | Japan . | |
| 177555 | 10/1984 | Japan . | |
| 177556 | 10/1984 | Japan . | |
| 177557 | 10/1984 | Japan . | |
| 178459 | 10/1984 | Japan . | |
| 19140 | 1/1985 | Japan . | |
| 26338 | 2/1985 | Japan . | |
| 26339 | 2/1985 | Japan . | |
| 158444 | 8/1985 | Japan . | |
| 162256 | 8/1985 | Japan . | |
| 172042 | 9/1985 | Japan . | |
| 70552 | 4/1986 | Japan . | |
| 30250 | 2/1987 | Japan . | |
| 0014146 | 1/1988 | Japan | 430/380 |

OTHER PUBLICATIONS

Copending application Ser. No. 07/063469 filed Jun. 18, 1988.

U.S. application Ser. No. 07/008,506, Ishikawa et al, Jan. 29, 1987.

U.S. application Ser. No. 07/013,513, Furatachi, Feb. 11, 1987.

U.S. application Ser. No. 07/015,400, Ishikawa et al., Feb. 17, 1987.

U.S. application Ser. No. 07/015,647, Fujita et al., Feb. 17, 1987.

U.S. application Ser. No. 07/039,203, Takahashi et al., Apr. 16, 1987.

U.S. application Ser. No. 07/051,437, Momuki et al., May 17, 1986.

U.S. application Ser. No. 07/054,176, Fujimoto et al., May 26, 1987.

U.S. application Ser. No. 07/059,669, Ikeda et al.

U.S. application Ser. No. 07/017,407, Koshimizu et al, Feb. 24, 1987.

U.S. application Ser. No. 07/018,380, Ishikawa et al., Feb. 24, 1987.

U.S. application Ser. No. 07/007,864, Sakai et al., Jan. 28, 1987.

U.S. application Ser. No. 07/037,288, Hirose et al., Apr. 10, 1987.

U.S. application Ser. No. 07/007,227, Aasami et al., Jan. 27, 1987.

U.S. application Ser. No. 07/008,436, Ishikawa et al., Jan. 29, 1987.

(List continued on next page.)

*Primary Examiner*—Richard L. Schilling

*Attorney, Agent, or Firm*—Sughrue, Mion, Zinn, Macpeak & Seas

[57] ABSTRACT

A method for continuously processing silver halide color photographic material with a color developer containing at least one aromatic primary amine color-developing agent is disclosed. In the method a silver halide color photographic material at least one of the layers of which contains a silver halide emulsion of a high chloride comprising 80 mol % or over of silver chloride is processed in the presence of a specific heterocyclic compound, after exposure to light, with a color developer that is substantially free from sulfite ions and whose replenishing amount is 120 ml or below per $m^2$ of the silver halide photographic material, to attain desired photographic characteristics.

16 Claims, No Drawings

OTHER PUBLICATIONS

U.S. application Ser. No. 07/007,248, Kishimoto et al., Jan. 27, 1987.
U.S. application Ser. No. 07/008,450, Waki et al., Jan. 29, 1987.
U.S. application Ser. No. 06/927,490, Fujita et al., Nov. 6, 1986.
U.S. application Ser. No. 07/006,511, Hirose et al., Jan. 23, 1987.
U.S. application Ser. No. 07/007,201, Takahashi et al. Jan. 27, 1987.
U.S. application Ser. No. 07/007,207, Ogawa et al., Jan. 27, 1987.
Copending application 07/018,380, filed Feb. 24, 1987.
Copending application 07/063,469, filed Jun. 18, 1988.

METHOD FOR PROCESSING SILVER HALIDE COLOR PHOTOGRAPHIC MATERIAL

This is a continuation of application Ser. No. 07/264,245 filed Oct. 28, 1988, now abandoned.

BACKGROUND OF THE INVENTION (1) Field of the Invention

The present invention relates to a method for processing silver halide color photographic materials, and in particular a method for developing silver halide color photographic materials in which the replenishing amount of the color developer is reduced considerably.

(2) Description of the Prior Art

Processing a silver halide color photographic material basically is composed of two steps of color development (for a color reversal material, black and white first development before it), and desilvering, and the desilvering comprises of a bleaching step and a fixing step, or a monobath bleach-fixing step that may be used alone or in combination with the bleaching step and the fixing step. If necessary, additional processing steps may be added, such as a washing step, a stopping step, a stabilizing step, and a pretreatment step to accelerate development.

In the color development, silver halide that has been exposed to light is reduced to silver, and at the same time the oxidized aromatic primary amine color-developing agent reacts with a coupler to form a dye. In this process, halogen ions resulted from the decomposition of the silver halide dissolve into the developer and accumulate therein. On the other hand, the color-developing agent is consumed by the above-mentioned reaction with the coupler. Further, other components in the color developer will be held into the photographic material and taken out, so that the concentrations of components in the developing solution lower gradually. Therefore, in a development method that continuously processes a large amount of a silver halide photographic material, for example by an automatic-developing processor, in order to avoid a change in the finished photographic characteristics for the development caused by a change in the concentrations of the components, some means is required to keep the concentrations of the components of the color developer within certain ranges.

For instance, if the influence of the condensation of a component that will be consumed, such as developing agents and preservatives, is small, generally its concentration in the replenisher has previously been made higher. In some cases, a material that will flow out and that has an effect of restraining development is contained in a lower concentration-in a replenisher, or is not contained in the replenisher. In other cases, a compound may be contained in a replenisher in order to remove the influence of a material that will flow out from the photographic material. Further, in other cases, for example, the pH, the alkali, or the concentration of a chelating agent is adjusted. As measures for them, usually a method of replenishing with replenishers is used that will supply insufficient components and dilute the increased components. The replenishment with the replenishers, however, necessarily results in a large amount of overflow, which creates large economic and public pollution problems.

In recent years, for the purpose of saving resources and avoiding the public pollution, it has been earnestly desired to reduce the replenishing amount of the developer as well as to accelerate the developing process. However, if the replenishing amount of a color developer is simply lowered, an exudate from the photographic material, in particular bromide ions that are a strong development restrainer, accumulates, resulting in a problem that lowers the development activity and impedes the development speed. To solve this problem, a technique of accelerating the development is required, and many such techniques that enable the replenishing amount to be lowered have been studied. One such known technique, for example, is to increase the pH and the processing temperature of the developer, thereby making the development rapid. This technique, however, causes such serious problems as a high degree of fogging, reduced stability of the developer, and a fluctuation of photographic characteristics as continuous processing increases. Another acceleration technique that involves adding various development accelerators is known, but it has not been satisfactorily effective.

For the purpose of lowering the accumulation of bromide ions, which are a strong development restrainer, thereby intending to make the development rapid, JP-A ("JP-A" means unexamined published Japanese patent application) Nos. 95345/1983, 232342/1984, and 70552/1986 and WO No. 04534/1987 disclose methods wherein silver halide photographic materials having high contents of silver chloride are used, and the methods are considered as effective means of lowering the replenishing amount of the developer without marring the rapidness of the development. It was found, however, that the methods were not of practical use because new problems arose that when the replenishing amount of the developer was intended to be lowered without marring the rapidness of the development, the photographic characteristics changed conspicuously in the continuous process, and a suspended matter considered as silver exuded from the photographic material occurred in the processing solution, which soiled the rollers of the processor, clogged a filter, and soiled or damaged the photographic material.

When the replenishing amount is lowered, as another major problem involved in the continuous process can be mentioned that there is a high degree of fogging of a silver halide color photographic material that has been developed. Since fogging is liable to differ greatly when a photographic material whose fogging is high is processed under such development conditions that the temperature or the pH rises, which readily causes fogging to occur, and under such development conditions that the temperature or the pH drops, which barely causes fogging to occur, therefore there will be great changes in the characteristics after development of such a photographic material.

As one means of preventing such fogging of a silver halide color photographic material is known to add various antifoggants to the photographic material. That is, it is known that compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolizine, and adenine have a remarkable effect in preventing fogging.

It is recognized that when common developer replenishing is carried out, such antifoggants and stabilizers as mentioned above exhibit an effect to minimize the change in the characteristics after development, but on the contrary when the developer replenishing amount is lowered considerably more than the usual amount, there were such problems that the antifoggant and stabilizer added to the photographic material caused after-development characteristics, the sensitivity in particular, to change greatly, as well as markedly reducing the silver developing speed.

At present, although the replenishing amount of a color developer varies a little depending on the photographic material to be developed, generally the replenishing amount is on the order of 180 to 1000 ml per $m^2$ of the photographic material to be processed. This is because if the replenishing amount is lowered while avoiding marring the rapidness of the development, the occurrence of quite serious problems, such as stated above that the photographic characteristics change greatly and that a suspended matter arises in the developer, is anticipated in the continuous process, and because a technique fundamentally solving these problems has not been found.

BRIEF SUMMARY OF THE INVENTION

Therefore, the first object of the present invention is to provide a developing method wherein the replenishing amount of color developer can be lowered remarkably without marring the rapidness of the process, and the with which photographic characteristics, in particular the minimum density, the maximum density, and the gradation, change less in the continuous process.

The second object of the present invention is to provide a developing method wherein a high-sliver-chloride-content photographic, material is used, the replenishing amount of the color developer can be lowered remarkably, and there is no occurrence of a suspended matter in the developer in the continuous process.

Other and further objects, features and advantages of the invention will appear more fully from the following description.

DETAILED DESCRIPTION OF THE INVENTION

The objects of the present invention have been accomplished by the methods stated below. That is, the present invention provides a method of continuously processing a silver halide color photographic material having a base with a color developer containing at least one aromatic primary amine color-developing agent, in which method a silver halide color photographic material at least one of the layers of which contains a silver halide emulsion of a high-sliver-chloride comprising 80 mol % or over of silver chloride is processed in the presence of a compound represented by the following formula (I):

$$Z—S—M \qquad (I)$$

wherein M represents a hydrogen atom, a cation (e.g., an alkali metal ion and an ammonium ion), or —S—Z, in which Z represents a heterocyclic residue containing one or more nitrogen atoms, with a color developer that is substantially free from benzyl alcohol and whose replenishing amount is 20 ml to 120 ml per $m^2$ of the silver halide photographic material.

A method wherein a high-chloride silver color photographic material whose silver chloride content is 80 mol % or over is used and the replenishing amount of color developer is lowered to 20 to 120 ml per $m^2$ of the photographic material without marring the rapid processability and which is involved in the present invention was conventionally impractical because the photographic characteristics, in particular the sensitivity, the maximum density, and the minimum density, conspicuously changed in the continuous process and suspended matter that seems attributable to silver exuded from the high-silver-chloride photographic material appeared in the developer, causing such problems as soiling the processor rollers, clogging a filter, and soiling and damage of the photographic material. It was unexpectedly found, however, that by processing continuously a high-silver-chloride color photographic material whose silver chloride content is 80 mol % or over in the presence of a compound of formula (I) with a color developer substantially free from benzyl alcohol as disclosed in the present invention, even if the replenishing amount of the color developer was lowered to 20 to 120 ml per $m^2$ of the photographic material, the change in the photographic characteristics became very small, and the above-mentioned occurrence of suspended matter in the processing solution could be remarkably prevented.

The following describes the range of the replenishing amount of the color developer in the present invention, that is, the amount of 20 to 120 ml per $m^2$ of the silver halide photographic material. To lower the replenishing amount of a developer to 120 ml or below per $m^2$ of a silver halide photographic material has been impractical in the prior art because of the problems discussed above, and it has therefore become possible for the first time by the present invention. The expression "replenishing amount of 120 ml per $m^2$ of photographic material" is a value at the boundary between the range that has become possible for the first time by the present invention and the range made possible by a combination of prior techniques. If the replenishing amount of the developer is less than 20 ml per $m^2$ of the photographic material, the amount of the processing solution carried over from the developing bath by the photographic material surpasses the replenishing amount, though the situation differs more or less depending on the type of photographic material, and the processing solution decreases to cause the continuous process to become impractical. The expression "replenishing amount of 120 ml per $m^2$ of photographic material" indicates the amount where the amount of the processing solution carried out by the photographic material and the replenishing amount become approximately equal, though the situation differs more or less depending on the type of photographic material.

A rapid-processing method that uses a high-silver chloride photographic material comprising 80 mol % or over of silver chloride which is used in the present method is known per se. Although international Laid-Open WO 04534/1987 discloses a process of processing a high-silver-chloride photographic material with a developer substantially free from benzyl alcohol and sulfite ions, the process is carried out in the absence of a compound of formula (I), and further neither describes at all problems involved when the photographic material is developed with the replenishing amount of the developer remarkably lowered, nor do they describe at all whether the above problems can be solved, which does not lead to the technique of the present invention, if an analogy is made. Further, although JP-A No. 70552/1986 discloses a continuous process of processing a high-silver-chloride photographic material with a developer substantially free from benzyl alcohol without allowing the replenishing amount to cause an overflow from the developing bath, the process is carried out in the absence of a compound of formula (I) and in the presence of sulfite ions, and neither describes at all the problems mentioned above that will occur when the replenishing amount of a developer is lowered remarkably, nor measures to solve these problems, which does not lead to the technique of the present invention, if an analogy is made.

The heterocyclic residue represented by Z in formula (I) may be condensed, and preferably, specific examples thereof are imidazole, triazole, tetrazole, thiazole, oxazole, selenazole, benzimidazole, benzoxazole, benzthiazole, thiadiazole, oxadiazole, benzselenazole, pyrazole, pyrimidine, triazine, naphthothiazole, naphthoimidazole, azabenzimidazole, purine, and azaindenes (e.g., triazaindene, tetrazaindene, and pentazaindene).

These heterocyclic residues and condensed rings may be substituted by a suitable substituent such as an alkyl group (e.g., methyl, ethyl, hydroxylethyl, trifluoromethyl, sulfopropyl, di-propylaminoethyl, and adamantane), an alkenyl group (e.g., allyl), an aralkyl group (e.g., benzyl, and p-chlorophenethyl), an aryl group (e.g., phenyl, naphthyl, p-carboxylphenyl, 3,5-di-carboxyphenyl, m-sulfophenyl, p-acetamidophenyl, 3-capramidophenyl, p-sulfamoylphenyl, m-hydroxyphenyl, p-nitrophenyl, 3,5-dichlorophenyl, and 2-methoxyphenyl), a heterocyclic residue (e.g., pyridine, furan, and thiophene), a halogen atom (e.g., a chlorine atom, and a bromine atom), a mercapto group, a cyano group, a carboxyl group, a sulfo group, a hydroxy group, a carbamoyl group, a sulfamoyl group, an amino group, a nitro group, an alkoxy group (e.g., methoxy), an aryloxy group (e.g., phenoxy), an acyl group (e.g., acetyl), an acylamino group (e.g., acetylamino, capramido, and methylsulfonylamino), a substituted amino group (e.g., diethylamino and hydroxyamino), an alkylthio group or an arylthio group (e.g., methylthio, carboxyethylthio, and sulfobutylthio), an alkoxycarbonyl group (e.g., methoxycarbonyl), and an aryloxycarbonyl group (e.g., phenoxycarbonyl).

The heterocyclic residue represented by Z in formula (I) is required to contain one or more nitrogen atoms, and preferably the heterocyclic residue contains two or more nitrogen atoms, more preferably three or more nitrogen atoms, and particularly preferably four nitrogen atoms.

Of the compounds represented by formula (I), compounds represented by the following formulas (I-I), (I-II), and (I-III) are particulary preferable.

Formula (I-I)

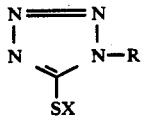

wherein R represents an alkyl group, an alkenyl group, or an aryl group; X represents a hydrogen atom, an alkali metal atom, an ammonium group, or a precursor.

An alkali metal atom is, for example, sodium atom, potassium atom, or the like, an ammonium group is, for example, tetramethylammonium group, trimethylbenzylammonium group, or the like. A precursor represents a group to form a compound wherein X=H or an alkali metal under alkali condition, for example, an acethyl group, a cyanoethyl group, a methanesulfonylethyl group.

Of the above-mentioned R, the alkyl group and alkenyl group may be both unsabstituted, substituted or alicyclic group. The substituents of substituted alkyl group can be mentioned are a halogen atom, a nitro group, a cyano group, a hydroxyl group, an alkoxy group, an aryl group, an acylamino group, an alkoxycarbonylamino group, an ureido group, an amino group, a heterocyclic group, an acyl group, a sulfamoyl group, a sulfonamido group, a thioureido group, a carbamoyl group, an alkylthio group, an arylthio group, and a heterocyclicthio group, and further a carboxylic acid, a sulfonic acid and salts thereof.

The above-mentioned ureido group, thioureido group, sulfamoyl group, carbamoyl group, and amino group each may be unsubstituted, N-alkyl substituted or N-aryl substituted. Examples of the aryl group can be mentioned are a phenyl group and a substituted phenyl group of which substituents are an alkyl group and the above-mentioned substituents of alkyl group.

Formula (I-II)

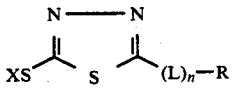

wherein L represents a divalent connecting group, R represents a hydrogen atom, an alkyl group, an alkenyl group, or an aryl group. The alkyl group, alkenyl group and X have the same meanings as in formula (I-I).

Examples of the divalent connecting group represented by above-mentioned L include

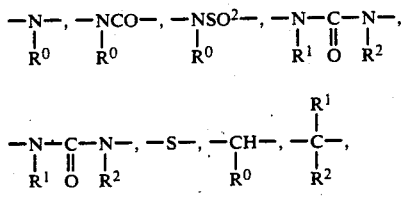

and combination thereof.

n represents 0 or 1, $R^0$, $R^1$, and $R^2$ each represent a hydrogen atom, an alkyl group, an aralkyl group.

Formula (I-III)

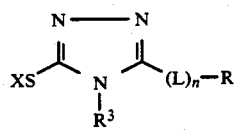

wherein R and X have the same meanings as in formula (I-I) an L has the same meanings as in formula (I-II). $R^3$ has the same meanings as R, and $R^3$ and R may be the same or different.

Specific examples of preferable mercapto-type compounds that can be used in the present invention are shown below, but the present invention is not limited to them.

(I-1)

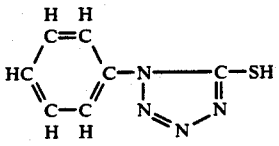

-continued
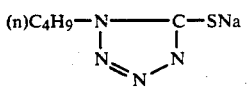
(I-2)
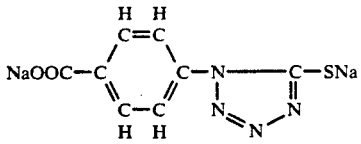
(I-3)
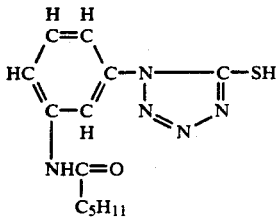
(I-4)
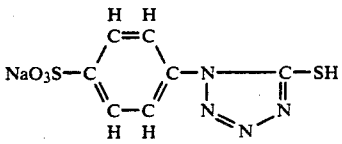
(I-5)
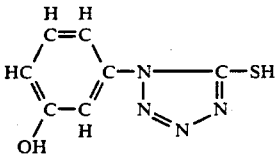
(I-6)
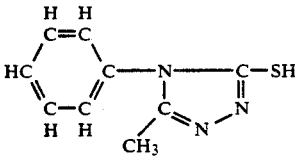
(I-7)
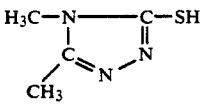
(I-8)
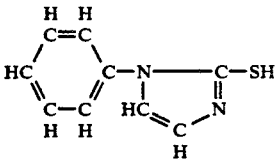
(I-9)
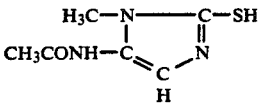
(I-10)
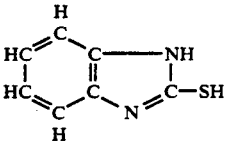
(I-11)
-continued
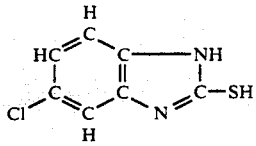
(I-12)
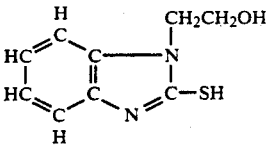
(I-13)
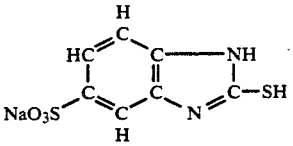
(I-14)
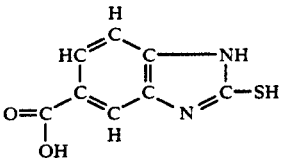
(I-15)
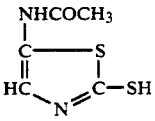
(I-16)
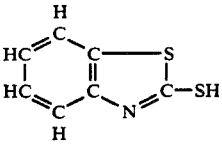
(I-17)
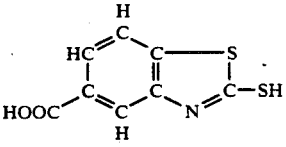
(I-18)
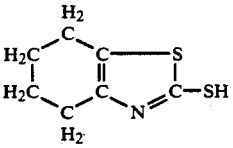
(I-19)
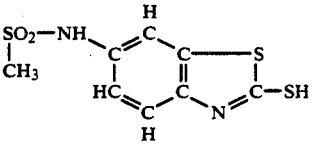
(I-20)
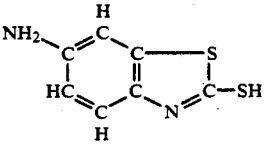
(I-21)

-continued
(I-22)
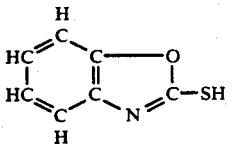
(I-23)
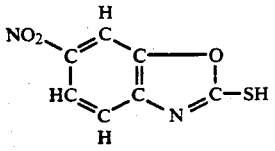
(I-24)
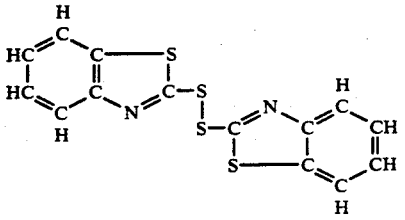
(I-25)
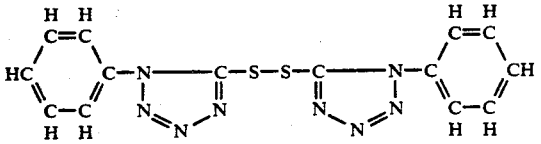
(I-26)
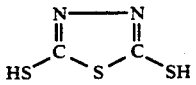
(I-27)
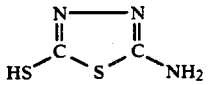
(I-28)
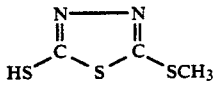
(I-29)
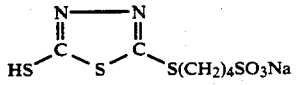
(I-30)
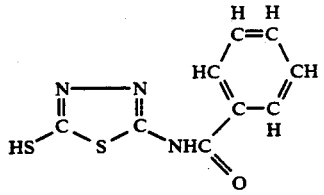
(I-31)
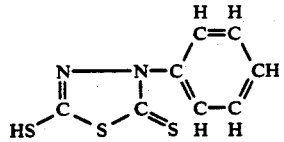
(I-32)
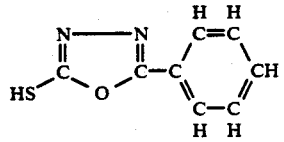
-continued
(I-33)
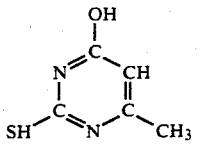
(I-34)
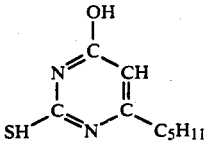
(I-35)
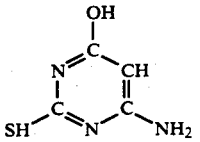
(I-36)
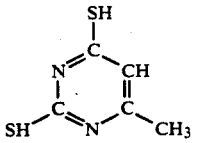
(I-37)
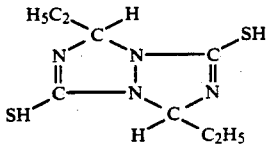
(I-38)
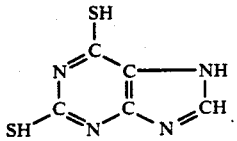
(I-39)
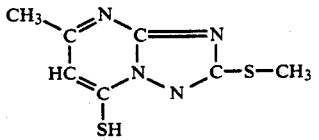
(I-40)
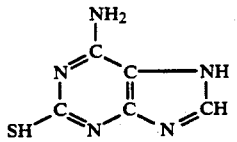
(I-41)
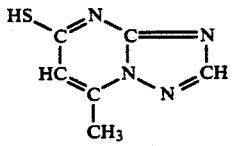
(I-42)
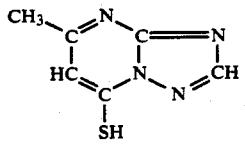

-continued (I-43)

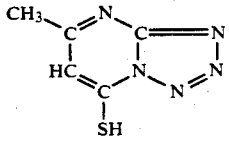

(I-44)

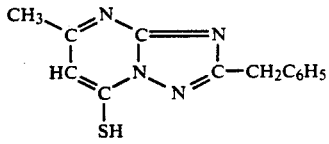

(I-45)

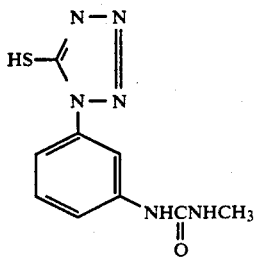

(I-46)

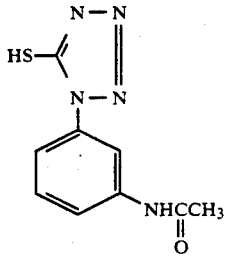

(I-47)

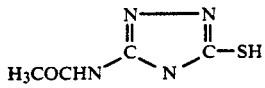

Specifically preferable ones of compounds represented by formula (I) are I-27, I-45, I-46, and I-47.

In the present invention, the compound represented by formula (I) may be present in a silver halide color photographic material and/or a color developer, and particularly it is more preferable that the compound is present in a silver halide color photographic material.

The compounds represented by formula (I) may be added alone or in combination.

If the compound represented by formula (I) is present in a silver halide color photographic material, the compound may be present in any layer of the photographic material, and it may be present in two or more layers of the photographic material. The amount of the compound to be added is preferably in the range of $1\times10^{-5}$ to $5\times10^{-2}$ mol, and more preferably $1\times10^{-4}$ to $1\times10^{-2}$ mol, per mol of the silver halide in the layer that will contain the compound (I). If the compound represented by formula (I) is present in a color developer, the amount of the compound to be added is preferably $1\times10^{-6}$ to $1\times10^{-3}$ mol, and more preferably $5\times10^{-6}$ to $5\times10^{-4}$ mol, per liter of the color developer.

In case, the amount of the compound of Formula (I) is too small, the effect to prevent fogging of silver halide emulsion becomes in sufficient, making the color impure. On the contrary, the amount of the compound of Formula (I) is too large, there is caused a decrease of sensitivity or a restraint of development to decrease the density, making the color reproduction inadequate.

The color developer that is used in the present invention will now be described in detail.

In the practice of the present invention, it is required to use a developer substantially free from benzyl alcohol. Herein the expression "substantially free from benzyl alcohol" means that the concentration of benzyl alcohol is preferably 2 ml/l or below, more preferably 0.5 ml/l or below, and most preferably none at all.

It is more preferable that the developer used in the present invention is substantially free from sulfite ions. Sulfite ions function as a preservative of developing agents, and at the same time they have an action to dissolve silver halides and an action to react with the oxidized product of developing agents, thereby lowering the dye-forming efficiency. Such actions are presumed to be one of the causes of increased changes in the photographic characteristics and the above-mentioned occurrence of suspended matter when the replenishing amount of a color developer is lowered. Herein the expression "substantially free from sulfite ions" means that the concentration of sulfite ions is $5.0\times10^{-3}$ mol/l, and most preferably none at all. However, in the present invention, a quite small amount of sulfite ions used to prevent the processing kit from being oxidized, in which kit a developer is condensed before preparing therefrom an intended solution, is excluded.

In the present invention, which is required to use the color-developing solution not containing sulfite ion substantialy, in order to restrain the retarioration of the developing solution, physical means, for example, to not use the developing solution for a long time, and to use a floating cover or to decrease the opened surface-ratio in the developing bath to repress the effect of oxydation by air, and chemical means, for example, to control the temperature of developing solution, and to add an organic preservative, may be employed. Of these means the method of using an organic preservative is advantageous in view of convenience.

The processing method of the present invention have an effect particularly on a continuous processing. Herein, "continuous processing" means a processing that is not a batch-processing, but is carried out continuously being maintained the processability constantly by means, for example, by adding a replenishing solution to get over the fatigue of processing solution accompanied with proceeding the developing process. It is generally to use an automatic developing machine.

It is preferable that the developer used in the present invention is substantially free from sulfite ions, and it is more preferable that further the developer is substantially free from hydroxylamine. This is because hydroxylamine, which functions as a preservative of developers, at the same time has an activity on the development of silver, and it is considered that a change in the concentration of hydroxylamine greatly affects the photographic characteristics. Herein the expression "substantially free from hydroxylamine" means that the concentration of hydroxylamine is preferably $5.0\times10^{-3}$ mol/l or below, and most preferably none at all.

It is required that the photographic material used in the present invention has, in at least one layer, a silver halide emulsion of a high silver chloride comprising 80 mol % or over of silver chloride, and it is quite preferable that the coating silver amount is 0.80 g/m$^2$ or below in terms of silver, in view of rapidness of the developing process and to prevent the above-mentioned occurrence of suspended matter. Further, the coating silver amount is preferably 0.3 g/m$^2$ or over, in view of image-density. From these points of view the coating amount of silver halide in terms of silver is more preferably 0.3 to 0.8 g/m$^2$, particularly preferably 0.4 to 0.7 g/m$^2$.

In the development of a high silver chloride silver halide grain, the ratio of solution physical development is high, especially higher in the latter period of development. As a result of various research, the inventors have found that the occurrence of the previously-described suspended matter in a developer relates to the dissolving speed and the solution physical development speed of unexposed silver halide grains. Further, the inventors have found that 0.8 g/m$^2$ of coating silver amount in a photographic material is the critical point of the occurence of suspended matter, such that suspended matter occurs remarkably when the coating silver amount is above 0.8 g/m$^2$, and decreases remarkably when the coating amount is 0.8 g/m$^2$ or below, preferably 0.7 g/m$^2$ or below, more preferably 0.65 g/m$^2$ or below.

The influence of coating silver amount of a photographic material on the dissolving speed of individual grains and on the speed of solution physical development was not known, further it is surprising that there is a critical point of the occurrence of suspended matter at 0.8 g/m$^2$ of coating silver amount.

Preferably the developer used in the present invention contains, instead of hydroxylamine and sulfite ions, an organic preservative.

The term "organic preservative" means organic compounds generally that can reduce the rate of deterioration of aromatic primary amine color-developing agents when added to the processing solution for the color photographic material. That is, organic preservatives are organic compounds having a function to prevent color photographic agents from being oxidized with air or the like, and in particular, hydroxylamine derivatives (excluding hydroxylamine), hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds, and condensed ring-type amines are effective organic preservatives. They are disclosed, for example, in JP-B Nos. 147823/1986, 173595/1986, 165621/1986, 188619/1986, 197760/1986, 186561/1986, 198987/1986, 201861/1986, 186559/1986, 170756/1986, 188742/1986, and 188741/1986, U.S. Pat. Nos. 3,615,503 and 2,494,903, JP-A No. 143020/1987, and JP-B ("JP-B" means examined Japanese patent publication) No. 30496/1973.

Regarding the preferable organic preservatives mentioned above, their formulas and typical compounds are mentioned below, but the present invention is not limited to them.

It is desirable that the amount of the compounds mentioned below to be added to the color developer is 0.005 to 0.5 mol/l, preferably 0.03 to 0.1 mol/l.

As hydroxylamines, the following are preferable:

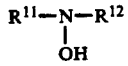

Formula (II)

wherein $R^{11}$ and $R^{12}$ each represent a hydrogen atom, a substituted or unsubstituted alkyl group, a substituted or unsubstituted alkenyl group, a substituted or unsubstituted aryl group, or a heteroaromatic group, they do not represent hydrogen atoms at the same time, and they may bond together to form a heterocyclic ring with the nitrogen atom.

The ring structure of the heterocyclic ring is a 5- to 6-membered ring, it is made up of carbon atoms, halogen atoms, oxygen atoms, nitrogen atoms, sulfur atoms, etc., and it may be saturated or unsaturated.

It is preferable that $R^{11}$ and $R^{12}$ each represent an alkyl group or an alkenyl group having preferably 1 to 10 carbon atoms, more preferably 1 to 5 carbon atoms. As nitrogen-containing heterocyclic rings formed by bonding $R^{11}$ and $R^{12}$ together can be mentioned, for example, a piperidyl group, a pyrolidyl group, an N-alkylpiperazyl group, a morpholyl group, an indolinyl group, and a benztriazole group.

Preferable substituents of $R^{11}$ and $R^{12}$ are a hydroxyl group, an alkoxy group, an alkylsulfonyl group, an arylsulfonyl group, an amido group, a carboxyl group, a cyano group, a sulfo group, a nitro group, and an amino group.

Exemplified compounds:

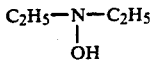

II-1

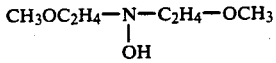

II-2

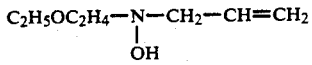

II-3

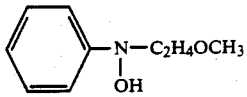

II-4

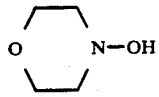

II-5

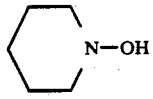

II-6

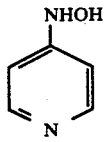

II-7

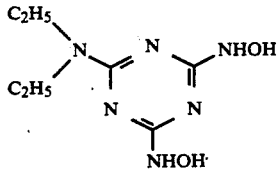

II-8

As hydroxamic acids the following compounds are preferable:

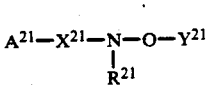

Formula (III)

wherein $A^{21}$ represents a hydrogen atom, a substituted or unsubstituted alkyl group, a substituted or unsubstituted aryl group, a substituted or unsubstituted amino group, a substituted or unsubstituted heterocyclic group, a substituted or unsubstituted alkoxy group, a substituted or unsubstituted aryloxy group, a substituted or unsubstituted carbamoyl group, a substituted or unsubstituted sulfamoyl group, an acyl group, a carboxy group, a hydroxyamino group, or a hydroxyaminocarbonyl group. As a substituent can be mentioned a halogen atom, an aryl group, an alkyl group, and an alkoxy group.

It is preferable that $A^{21}$ represents a substituted or unsubstituted alkyl group, a substituted or unsubstituted aryl group, a substituted or unsubstituted amino group, a substituted or unsubstituted alkoxy group, or a substituted or unsubstituted aryloxy group. Particularly preferable examples include a substituted or unsubstituted amino group, a substituted or unsubstituted alkoxy group, and a substituted or unsubstituted aryloxy group. The number of carbon atoms is preferably 1 to 10.

$X^{21}$ represents $-\underset{\underset{O}{\|}}{C}-$, $-\underset{\underset{S}{\|}}{C}-$, $-SO_2-$, or $-SO-$.

Preferably $X^{21}$ is $-\underset{\underset{O}{\|}}{C}-$.

$R^{21}$ represents a hydrogen atom, a substituted or unsubstituted alkyl group, or a substituted or unsubstituted aryl group. $A^{21}$ and $R^{21}$ may together form a ring structure. The substituents are the same as mentioned in $A^{21}$. $R^{21}$ is preferably a hydrogen atom.

$Y^{21}$ represents a hydrogen atom or a group that can become a hydrogen atom by a hydrolysis reaction.

Exemplified compound:

III-1

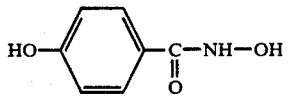

III-2

$CH_3-\underset{\underset{O}{\|}}{C}-NH-OH$

III-3

$C_4H_9O-\underset{\underset{O}{\|}}{C}-NH-OH$

III-4

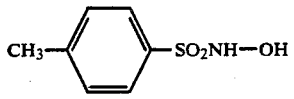

III-5

$CH_3-\underset{\underset{S}{\|}}{C}-\overset{\overset{CH_3}{|}}{N}-OH$

III-6

$H_2N-\underset{\underset{O}{\|}}{C}-NH-OH$

As hydrazines and hydrazides the following compounds are preferable:

Formula (IV)

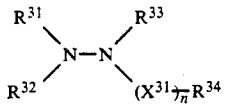

wherein $R^{31}$, $R^{32}$, and $R^{33}$ each independently represent a hydrogen atom, a substituted or unsubstituted alkyl group, a substituted or unsubstituted aryl group, or a substituted or unsubstituted heterocyclic group; $R^{34}$ represents a hydroxy group, a hydroxyamino group, a substituted or unsubstituted alkyl group, a substituted or unsubstituted heterocyclic group, a substituted or unsubstituted alkoxy group, a substituted or unsubstituted aryloxy group, a substituted or unsubstituted carbamoyl group, or a substituted or unsubstituted amino group. The heterocyclic group is a 5- or 6-membered ring made up of C, H, O, N, S, and/or a halogen atom, and it may be substituted or unsubstituted. $X^{31}$ represents a divalent group selected from —CO—, —SO—, and $-\overset{\overset{NH}{\|}}{C}-$;

n is 0 or 1, provided that when n=0, $R^{34}$ represents a group selected from an alkyl group, an aryl group, or a heterocyclic group. $R^{33}$ and $R^{34}$ may together form a heterocyclic ring.

In formula (IV), $R^{31}$, $R^{32}$, and $R^{33}$ each are preferably a hydrogen atom or an alkyl group having 1 to 10 carbon atoms, particularly $R^{31}$ and $R^{32}$ each are most preferably a hydrogen atom.

In formula (IV), $R^{34}$ is preferably an alkyl group having 1 to 20 carbon atoms, an aryl group having 6 to 20 carbon atoms, an alkoxy group having 1 to 20 carbon atoms, a carbamoyl group having 1 to 20 carbon atoms, or an amino group having 0 to 20 carbon atoms, in particular preferable an alkyl group or a substituted alkyl group. The preferably substituents of an alkyl group include a carboxyl group, a sulfo group, a nitro group, an amino group, and a phosphono group. $X^{31}$ is preferably —CO— or $-SO_2-$, most preferably —CO—.

Exemplified compounds:

IV-1

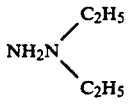

IV-2

$NH_2NH\leftarrow CH_2\rightarrow_4 SO_3H$

IV-3

$NH_2NH\leftarrow CH_2\rightarrow_2 OH$

IV-4

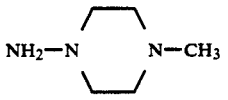

IV-5

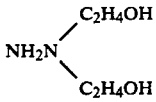

-continued $NH_2NHCOCH_3$ IV-6

$NH_2NHCOOC_2H_5$ IV-7

IV-8

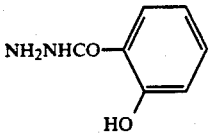

IV-9

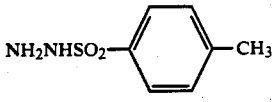

$NH_2NHCONH_2$ IV-10

IV-11

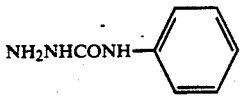

$NH_2NHSO_3H$ IV-12

IV-13

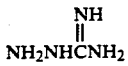

$NH_2NHCOCONHNH_2$ IV-14

$NH_2NHCH_2CH_2CH_2SO_3H$ IV-15

IV-16

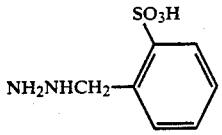

IV-17

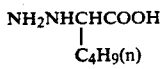

$NH_2NHCH_2CH_2COOH$ IV-18

IV-19

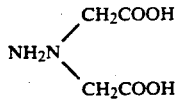

IV-20

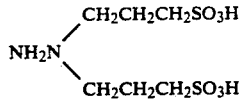

IV-21

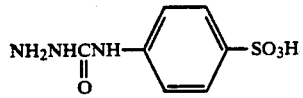

IV-22

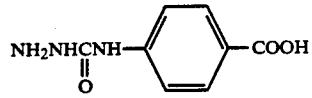

As phenols the following compounds are preferable:

Formula (V)

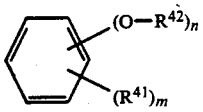

wherein $R^{41}$ represents a hydrogen atom, a halogen atom, an alkyl group, an aryl group, an alkoxy group, an aryloxy group, a carboxy group, a sulfo group, a carbamoyl group, a sulfamoyl group, an amido group, a sulfonamido group, an ureido group, an alylthio group, an arylthio group, a nitro group, a cyano group, an amino group, a formyl group, an acyl group, a sulfonyl group, an alkoxycarbonyl group, an aryloxycarbonyl group, an alkoxysulfonyl group, or a aryloxysulfonyl group. When $R^{41}$ is further substituted, as the substituent can be mentioned a halogen atom, an alkyl group, an aryl group, a hydroxyl group, and an alkoxy group. When $R^{41}$ is present 2 or more in number, they may be the same or different, and if they are adjacent, they may together form a ring. The ring structure may be a 5- or 6-membered ring, which is made up of C, H, a halogen atom, O, N, etc. They may be saturated or unsaturated. $R^{42}$ represents a hydrogen atom or a hydrolyzable group, and m and n each are integers of 1 to 5.

In formula (V), preferably $R^{41}$ represents an alkyl group, a halogen atom, an alkoxy group, an alkylthio group, a carboxyl group, a sulfo group, a carbamoyl group, an amino group, an amido group, a sulfonamido group, a nitro group, or a cyano group. It is particularly preferable that $R^{41}$ represent an alkoxy group, an alkylthio group, an amino group, or a nitro group, which is preferably in the position ortho or para to the $(OR^{42})$ group. Preferably the number of carbon atoms of $R^{41}$ is 1 to 10, most preferably 1 to 6.

Preferably $R^{42}$ is a hydrogen atom or a hydolyzable group having 1 to 5 carbon atoms. If the $(OR^{42})$ group is present 2 or more in number, it is preferable that they are positioned ortho or para to each other.

Exemplified compounds:

V-1

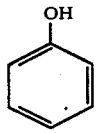

V-2

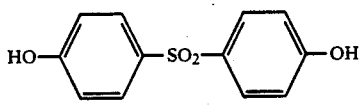

V-3

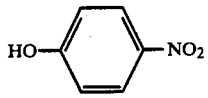

V-4

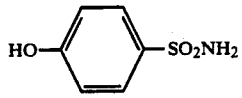

V-5

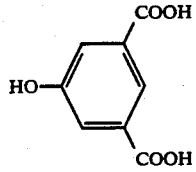

V-6

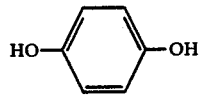

-continued

V-7

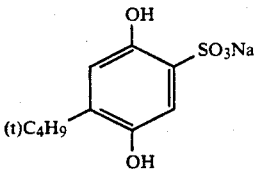

V-8

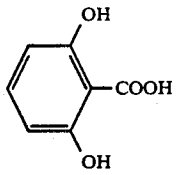

V-9

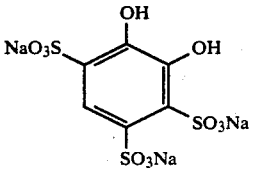

V-10

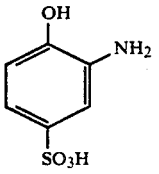

V-11

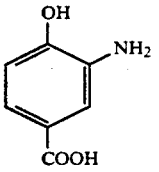

As α-hydroxyketones and α-aminoketones the following compounds are preferable:

Formula (VI)

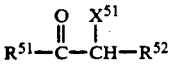

wherein $R^{51}$ represents a hydrogen atom, a substituted or unsubstituted alkyl group, a substituted or unsubstituted aryl group, a substituted or unsubstituted alkoxy group, a substituted or unsubstituted aryloxy group, or a substituted or unsubstituted amino group; $R^{52}$ represents a hydrogen atom, a substituted or unsubstituted alkyl group, or a substituted or unsubstituted aryl group; $R^{51}$ and $R^{52}$ may together form a carbocyclic ring or a heterocyclic ring; and $X^{51}$ represents a hydroxyl group or a substituted or unsubstituted amino group.

In formula (V), preferably $R^{51}$ represents a hydrogen atom, an alkyl group, an aryl group, or an alkoxy group, and $R^{52}$ represents a hydrogen atom or an alkyl group.

Exemplified compounds:

VI-1

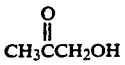

VI-2

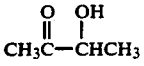

-continued

VI-3

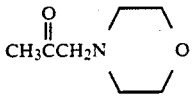

VI-4

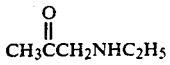

VI-5

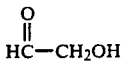

VI-6

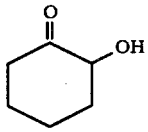

VI-7

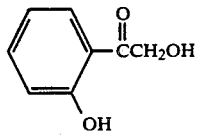

VI-8

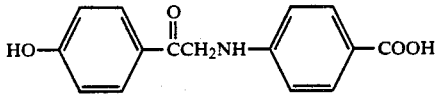

VI-9

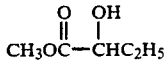

VI-10

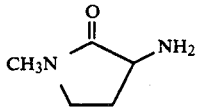

Saccharides are also preferable organic preservatives.

Saccharides (also called carbohydrate) comprise monosaccharides and polysaccharides, and many have the general formula $C_nH_{2m}O_m$. "Monosaccharides" is a term for aldehydes and ketones of polyhydric alcohols (called, respectively, aldoses and ketoses), and their derivatives, such as reduced derivatives, oxidized derivatives, and dehydrated derivatives, as well as aminosaccharides and thiosaccharides. Polysaccharides refer to products obtained by condensing two or more such monosaccharides accompanied by dehydration.

Of these saccharides, preferable are aldoses having a reducing aldehyde group and their derivatives, and more preferably those belonging to monosaccharides.

Exemplified compounds:

VII-1 D-Xylose
VII-2 D-Arabinose
VII-3 D-Ribose
VII-4 D-Deoxyribose
VII-5 D-Glucose
VII-6 D-Galactose
VII-7 D-Mannose
VII-8 Glucosamine
VII-9 L-Sorbose
VII-10 D-Sorbit (Sorbitol)

As monoamines can be mentioned:

Formula (VIII)

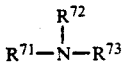

wherein $R^{71}$, $R^{72}$, and $R^{73}$ each represent a hydrogen atom, an alkyl group, an alkenyl group, an aryl group, an aralkyl group or a heterocyclic group, and $R^{71}$ and $R^{72}$, $R^{71}$ and $R^{73}$, or $R^{72}$ and $R^{73}$ may bond together to form a nitrogen-containing heterocyclic group.

$R^{71}$, $R^{72}$, and $R^{73}$ may have a substituent. Particularly preferably $R^{71}$, $R^{72}$, and $R^{73}$ each represent a hydrogen atom or an alkyl group. As a substituent can be mentioned, for example, a hydroxyl group, a sulfo group, a carboxyl group, a halogen atom, a nitro group, and an amino group.

Exemplified compounds:

$N(CH_2CH_2OH)_3$ VIII-1

$H_2NCH_2CH_2OH$ VIII-2

$HN(CH_2CH_2OH)_2$ VIII-3

$C_7H_{15}N(CH_2CH(OH)CH_2OH)_2$ VIII-4

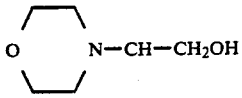
VIII-5

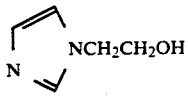
VIII-6

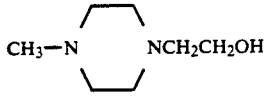
VIII-7

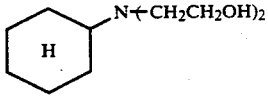
VIII-8

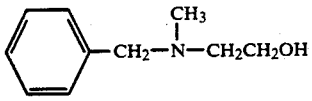
VIII-9

$(HOCH_2CH_2)_2NCH_2CH_2SO_2CH_3$ VIII-10

$HN(CH_2COOH)_2$ VIII-11

$HOOCCH_2CH_2CH(NH_2)COOH$ VIII-12

$H_2NCH_2CH_2SO_2NH_2$ VIII-13

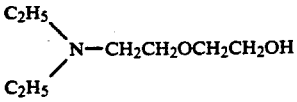
VIII-13

$H_2N-C(CH_2OH)_2$ VIII-14

$HOCH_2CH(NH_2)COOH$ VIII-15

-continued

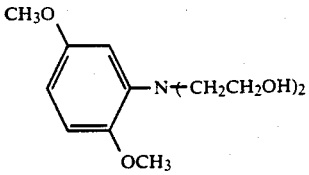
VIII-16

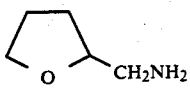
VIII-17

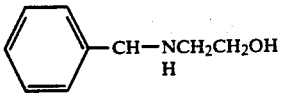
VIII-18

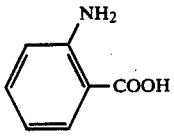
VIII-19

As diamines, the following are preferable:

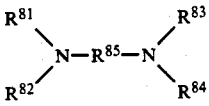
Formula (IX)

wherein $R^{81}$, $R^{82}$, $R^{83}$, and $R^{84}$ each represent a hydrogen atom, an alkyl group, an alkenyl group, an aryl group, an aralkyl group, or a heterocyclic group, and $R^{85}$ represents a divalent organic group, specifically an alkylene group, an arylene group, an aralkylene group, an alkenylene group, or a heterocyclic group.

Particularly preferably $R^{81}$, $R^{82}$, $R^{83}$, and $R^{84}$ each represent a hydrogen atom, or an alkyl group, and $R^{85}$ represents an alkylene group.

Exemplified compounds:

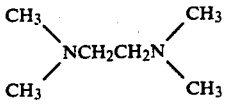
IX-1

$(HOCH_2CH_2)_2NCH_2CH_2N(CH_2CH_2OH)_2$ IX-21

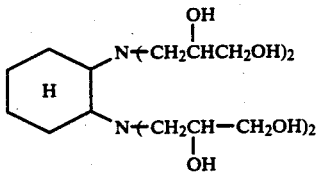
IX-3

$H_2NCH_2CH_2N(CH_2CH_2OH)_2$ IX-4

$H_2NCH_2CH(OH)CH_2NH_2$ IX-5

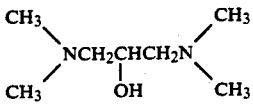
IX-6

-continued

IX-7

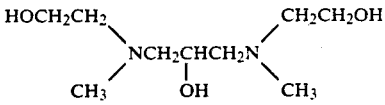

IX-8

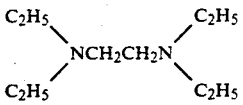

IX-9

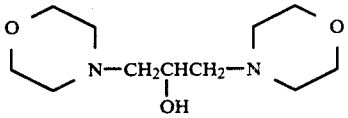

IX-10

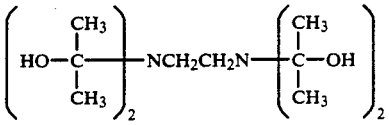

IX-11

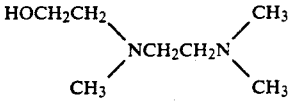

As polyamines the following are preferable:

Formula (X)

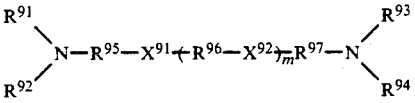

wherein $R^{91}$, $R^{92}$, $R^{93}$, and $R^{94}$ each represent a hydrogen atom, an alkyl group, an alkenyl group, an aryl group, an aralkyl group, or a heterocyclic group, $R^{95}$, $R^{96}$, and $R^{97}$ each represent a divalent organic group, and specifically have the same meaning as that of $R^{85}$ of formula (VIII), $X^{91}$ and $X^{92}$ each represent

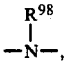

—O—, —S—, —CO—, $SO_2$—, —SO—, or a linking group formed by a combination of these linking groups, $R^{98}$ has the same meaning as that of $R^{91}$, $R^{92}$, $R^{93}$ and $R^{94}$, and m is an integer of 1 or over (there is no particular upper limit to m, and if the compound is soluble in water, the compound may have a high molecular weight, but generally m is in the range of 1 to 3).

Exemplified compounds:

X-1

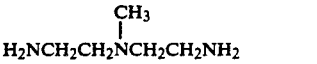

X-2

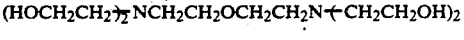

X-3

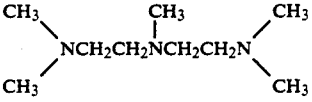

-continued

X-4

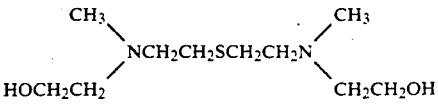

X-5

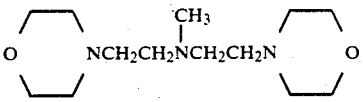

X-6

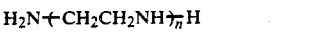

n = 500 ~ 20,000

X-7

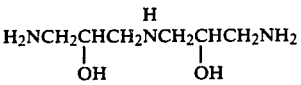

X-8

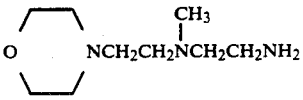

As quaternary ammonium salts, the following are preferable:

Formula (XI)

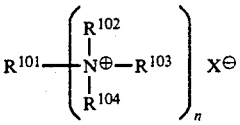

wherein $R^{101}$ represents an n-valent organic group, $R^{102}$, $R^{103}$, and $R^{104}$ each represent a monovalent organic group, which is a group having one or more carbon atoms, and specifically, for example, an alkyl group, an aryl group, or a heterocyclic group, at least two or more of $R^{102}$, $R^{103}$, and $R^{104}$ may bond together to form a heterocyclic ring containing the quaternary ammonium atom, n is an integer of 1 or over, and $X^{\ominus}$ represents a counter anion.

Particularly preferable monovalent groups of the monovalent groups represented by $R^{102}$, $R^{103}$, and $R^{104}$ are substituted or unsubstituted alkyl groups, and most preferably at least one of $R^{102}$, $R^{103}$, and $R^{104}$ is a hydroxyl group, an alkoxyalkyl group, or a carboxylalkyl group. Preferably n is an integer of from 1 to 3, more preferably 1 or 2.

Exemplified compounds:

XI-1

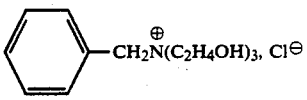

XI-2

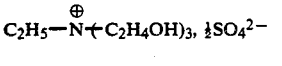

XI-3

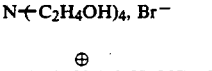

XI-4

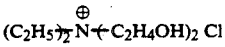

XI-5

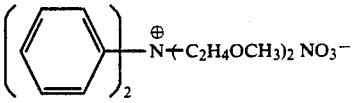

-continued

XI-6

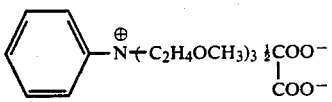

XI-7

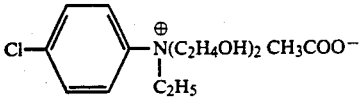

XI-8

$(HOC_2H_4)_3\overset{\oplus}{N}-C_2H_4-\overset{\oplus}{N}(C_2H_4OH)_3\ SO_4^{2-}$

XI-9

$(HOC_2H_4)_2\overset{\oplus}{N}(CH_2)_3\overset{\oplus}{N}(C_2H_4OH)_2\ 2Cl^-$

XI-10

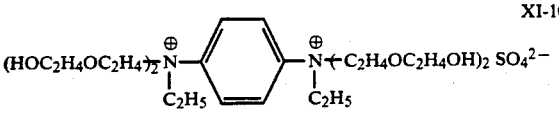

As nitroxy radicals, the following are preferable:

Formula (XII)

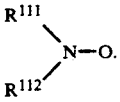

wherein $R^{111}$ and $R^{112}$ each represent a hydrogen atom, an alkyl group, an aryl group, or a heterocyclic group which may have a substituent, such as a hydroxy group, an oxy group, a carbamoyl group, an alkoxy group, a sulfamoyl group, a carboxy group, and a sulfo group. Examples of the heterocyclic group are a pyridyl group, and a piperidyl group, and preferably $R^{111}$ and $R^{112}$ each represent a substituted or unsubstituted aryl group, or a tertiary alkyl group such as a t-butyl group.

Exemplified compounds:

XII-1

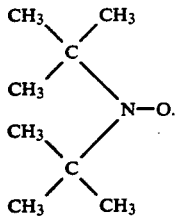

XII-2

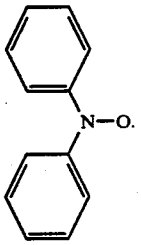

-continued

XII-3

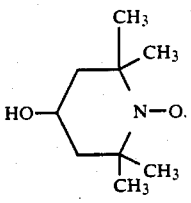

XII-4

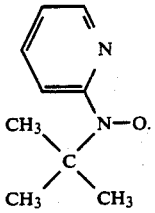

XII-5

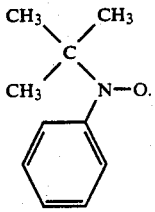

As alcohols, the following are preferable:

Formula (XIII)

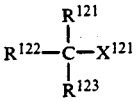

wherein $R^{121}$ represents a hydroxy-substituted alkyl group, $R^{122}$ represents an unsubstituted alkyl group or has the same meaning as that of $R^{121}$, $R^{123}$ represents a hydrogen atom or has the same meaning as that of $R^{122}$, and $X^{121}$ represents a hydroxy group, a carboxyl group, a sulfo group, a nitro group, an unsubstituted or hydroxysubstituted alkyl group, a substituted or unsubstituted amido group, or a sulfonamido group.

In formula (XII), preferably $X^{121}$ represents a hydroxy group, a carboxyl group, or a hydroxyalkyl group.

Exemplified compounds:

XIII-1

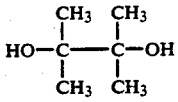

XIII-2

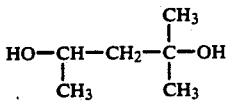

XIII-3

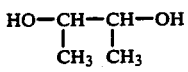

XIII-4 $HO-CH(CH_2OH)_2$

XIII-5 $(HO-CH_2)_3COOH$

XIII-6 $C(CH_2OH)_4$

XIII-7 $(HOCH_2)_3C-CH_3$

XIII-8 $(HOCH_2)_3C-NHCOCH_3$

-continued $(HOCH_2)_2C(CH_3)-SO_3H$ XIII-9

$HO-CH(CH_2OH)-CH_2CH_2OH$ XIII-10

As alcohols, the following are preferable:

$R^{131}-O-(CH(R^{133})-CH_2-O)_n-R^{132}$ Formula (XIV)

wherein $R^{131}$, $R^{132}$, and $R^{133}$ each represent a hydrogen atom or an alkyl group, and n is a positive integer up to 500.

Preferably the alkyl group represented by $R^{131}$, $R^{132}$, and $R^{133}$ is one having 5 or less carbon atoms, more preferably 2 or less carbon atoms. It is very preferable that $R^{131}$, $R^{132}$, and $R^{133}$ each represent a hydrogen atom or a methyl group, with a hydrogen atom most preferred.

Preferably, n is a positive integer of 100 or below, more preferably as low as 3 or as high as 30.

Exemplified compounds:

$HO(CH_2CH_2O)_4OH$ XIV-1

$CH_3O(CH_2CH_2O)_3OH$ XIV-2

$CH_3O(CH_2CH_2O)_2OCH_3$ XIV-3

$HO(CH(CH_3)CH_2O)_2OH$ XIV-4

$HOCH_2CH_2OCH_3$ XIV-5

$C_2H_5O(CH_2CH_2O)_2OH$ XIV-6

$HO(CH_2CH_2O)_nH$ XIV-7
av. molecular weight: about 300

$HO(CH_2CH_2O)_nH$ XIV-8
av. molecular weight: about 800

$HO(CH_2CH_2O)_nH$ XIV-9
av. molecular weight: about 3000

$HO(CH_2CH_2O)_nH$ XIV-10
av. molecular weight: about 8000

As oximes, the following are preferable:

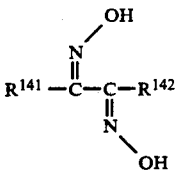
Formula (XV)

wherein $R^{141}$ and $R^{142}$, which may be the same or different, each represent a hydrogen atom, a substituted or unsubstituted alkyl group, or a substituted or unsubstituted aryl group, and $R^{141}$, and $R^{142}$ may bond together.

In formula (XIV), preferably $R^{141}$ and $R^{142}$ each represent an alkyl group that may be substituted by a halogen atom, a hydroxyl group, an alkoxy group, an amino group, a carboxyl group, a sulfo group, a phosphonic acid group, or a nitro group.

Preferably the sum of the carbon atoms in formula (XIV) is 30 or below, and more preferably 20 or below.

Exemplified compounds:

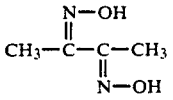
XV-1

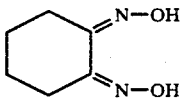
XV-2

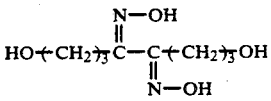
XV-3

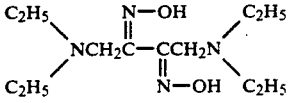
XV-4

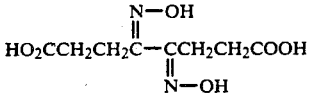
XV-5

As polyamines, the following are preferable:

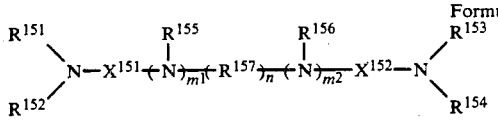
Formula (XVI)

wherein $X^{151}$ and $X^{152}$ each represent —CO— or —$SO_2$—, $R^{151}$, $R^{152}$, $R^{153}$, $R^{154}$, $R^{155}$, and $R^{156}$ each represent a hydrogen atom or a substituted or unsubstituted alkyl group, $R^{157}$ represents a substituted or unsubstituted alkylene group, a substituted or unsubstituted arylene group, or a substituted or unsubstituted aralkylene group, and m, m, and n each are 0 or 1.

Exemplified compounds:

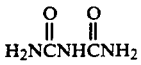
XVI-1

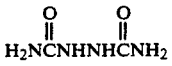
XVI-2

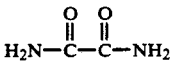
XVI-3

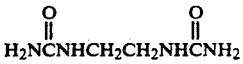
XVI-4

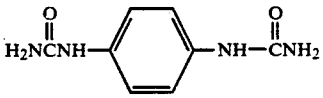
XVI-5

$H_2NSO_2NHSO_2NH_2$ XVI-6

As amines having a condensed ring the following compounds are preferable:

Formula (XVII)

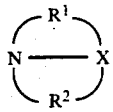

wherein X represents a trivalent group of atoms necessary to complete a condensed ring, and $R^1$ and $R^2$ each represent an alkylene group, an arylene group, an alkenylene group, or an aralkylene group.

$R^1$ and $R^2$ may be the same or different.

Of the compounds represented by formula (XVI), particularly preferable compounds are those represented by formulas (1-a) and (1-b):

Formula (1-a)

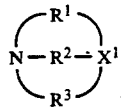

wherein $X^1$ represents N or CH, $R^1$ and $R^2$ have the same meaning as defined above for formula (XVII), and $R^3$ has the same meaning as $R^1$ or $R^2$ or represents

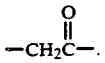

In formula (1-a), preferably $X^1$ represents $\equiv$N. Preferably the number of carbon atoms of $R^1$, $R^2$, and $R^3$ is 6 or below, more preferably 3 or below, and most preferably 2.

Preferably $R^1$, $R^2$, and $R^3$ each represent an alkylene group or an arylene group, most preferably an alkylene group.

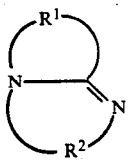

wherein $R^1$ and $R^2$ have the same meaning as defined in formula (XVI).

In formula (1-b), preferably the number of carbon atoms of $R^1$ and $R^2$ is 6 or below. Preferably $R^1$ and $R^2$ each represent an alkylene group or an arylene group, most preferably an alkylene group.

Of compounds represented by formulas (1-a) and (1-b), those represented by formula (1-a) are preferable.

XVII-1

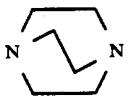

XVII-2

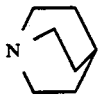

-continued

XVII-3

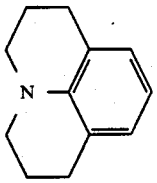

XVII-4

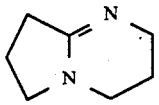

XVII-5

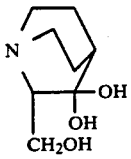

XVII-6

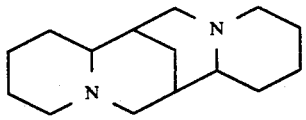

XVII-7

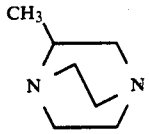

XVII-8

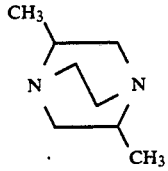

XVII-9

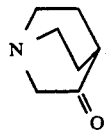

XVII-10

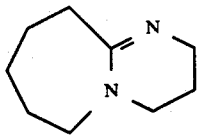

XVII-11

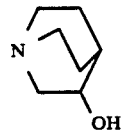

XVII-12

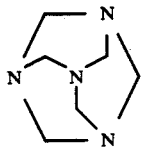

-continued

XVII-13

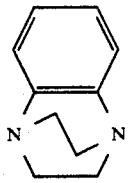

XVII-14

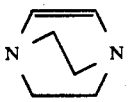

XVII-15

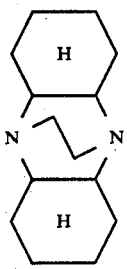

XVII-16

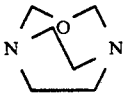

XVII-17

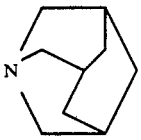

XVII-18

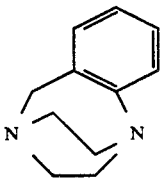

Many of the compounds represented by formula (XVII) according to the present invention are readily available commercially.

In the above-described formulas (II) to (XVII), except the case particularly denoted, the number of carbon atoms of the aliphatic substituents (e.g., an alkyl or an alkenyl) or the groups containing them is preferably 1 to 10, more preferably 1 to 6, and the number of carbon atoms of the aromatic substituents (e.g., an aryl) or the group containing them is preferably 1 to 8, more preferably 1 to 5.

Two or more of the above-mentioned preservatives can be used in combination. Preferable combinations include that of at least one compound represented by formulas (II) to (VII) and at least one compound represented by formulas (VIII) to (XVII).

More preferable combinations to use are that of at least one compound represented by formula (II) or (IV) and at least one compound represented by formula (VIII) or (XVII).

It is more preferably in view of preventing the occurrence of the above-mentioned suspended matter in the developer that a photographic material-applied silver halide emulsion in a coating amount of 0.8 g/m$^2$ or below in terms of silver is subjected to a developing process using a color-developer that which contains the above-described organic preservative represented by formula (II) or (IV).

Although the role of an organic preservative in the prevention of suspended matter is not clear, it is presumed that the silver halide-dissolvability, the silver-development-activity, and the reducing ability of the organic preservative may be concerned.

The color-developing solution for use in the present invention is described below.

The color-developing solution for use in the present invention may contain a known aromatic primary amine color-developing agent. Preferred examples are p-phenylenediamine derivatives. Representative examples are given below, but they are not meant to limit the present invention:

D-1: N,N-Diethyl-p-phenylenediamine

D-2: 4-[N-Ethyl-N-(β-hydroxyethyl)amino]aniline

D-3: 2-Methyl-4-[N-ethyl-N-(β-hydroxyethyl)amino]-aniline

D-4: 4-Amino-3-methyl-N-ethyl-N-(β-methanesulfonamido ethyl)aniline

It is particularly preferable to use D-4.

These p-phenylenediamine derivatives may be in the form of salts, such as sulfates, hydrochloride, sulfites, and p-toluenesulfonates. The amount of said aromatic primary amine developing agent to be used is preferably about 0.1 g to about 20 g, more preferably about 0.5 g to about 10 g, per liter of developer.

Preferably the pH of the color-developer of the present invention is in the range of 9 to 12, more preferably 9 to 11.0, and other known compounds that are components of a conventional developing solution can be contained.

To maintain the above-mentioned pH-value, it is preferable to use various buffer agents. Examples of buffer agents that can be mentioned include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salycylate), potassium o-hydroxybenzoate, sodium 5-sulfo-2-hydroxybenzoate (sodium 5-sulfosalycylate), and potassium 5-sulfo-2-hydroxybenzoate (potassium 5-sulfosalycylate).

Preferably the amount of buffer agent to be added is 0.1 mol/liter or over, more preferably 0.1 to 0.4 mol/-liter.

In addition, various chelating agents may also be used in the color-developer, as a suspension agent for calcium and magnesium or for improving the stability of the color-developer.

Specific examples will be given below. The present invention, however, is not limited to them:

Nitrilotriacetic acid

Diethylenetriaminepentaacetic acid

Ethylenediaminetetraacetic acid

Triethylenetetraminehexaacetic acid

N,N,N-trimethylenephosphonic acid

Ethylenediamine-N,N,N',N'-tetramethylenephosphonic acid 1,3-Diamino-2-propanoltetraacetic acid Transcyclohexanediaminetetraacetic acid Nitrilotripropionic acid 1,2-Diaminopropanetetraacetic acid Hydroxyethyliminodiacetic acid
Glycoletherdiaminetetraacetic acid
Hydroxyethylenediaminetriacetic acid
Ethylenediamineorthohydroxyphenylacetic acid
2-Phosphonobutane-1,2,4-tricarboxylic acid
1-Hydroxyethylidene-1,1-diphosphonic acid
N,N'-Bis(2-hydroxybenzyl)ethylenediamine-N,N'-diacetate These chelating agents may, if necessary, be used in a combination of two or more compounds.

These chelating agents may each be added in an amount sufficient to sequester metal ions in the color-developer, for example, in an amount of about 0.1 g to 10 g per liter of color-developing solution.

An arbitrary development accelerator may, if needed, be added to the color-developer.

As a development accelerator, each one of thioether compounds disclosed, for example, in JP-B Nos. 16088/1962, 5987/1962, 7826/1963, 12380/1969, and 9019/1970, and U.S. Pat. No. 3,813,247; p-phenylenediamine compounds disclosed in JP-A Nos. 49829/1977 and 15554/1975; quaternary ammonium salts disclosed in JP-A No. 137726/1975, JP-B No. 30074/1969, and JP-A Nos. 156826/1981 and 43429/1977; p-aminophenols described in U.S. Pat. Nos. 2,610,122 and 4,119,462; amine compounds described in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkyleneoxides described in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolydones; hydrazines; mesoionic-type compounds; ionic type compounds; and imidazoles may be added as needed.

In the present invention in addition to the compound represented by Formula (I) an arbitrary antifoggant may be added if required. Antifoggants that can be added include alkali metal halides, such as sodium chloride, potassium bromide, potassium iodide, and organic antifoggants. Representative examples of organic antifoggants include nitrogen-containing heterocyclic compounds such as benzotriazole, 6-nitrobenzimidazole, 5-nitrobenzotriazole, 5-chloro-benzotriazole, 2-thiazolylbenzimidazole, 2-thiazolyl-methylbenzimidazole, indazoles, hydroxyazindolizine, and adenine.

It is particularly preferable that the color developer contains both chloride ion in the range of $3.5\times10^{-2}$ to $1.5\times10^{-1}$ mol and bromide ion in the range of $3.0\times10^{-5}$ to $1.0\times10^{-3}$ mol, per liter of the color developer, in view of reducing the change of photographic properties (especially the increase of minimum density and the change of sensitivity) due to a continuous processing.

The above-mentioned chloride ion and bromide ion may be added directly, or accumulated in the developer by dissolving from the photographic material.

It is preferable that the color-developer of the present invention contain a fluorescent brightening agent. As a fluorescent brightening agent, 4,4'-diamino-2,2'-disulfostilbene compounds are preferable. The amount of addition is in the range of 0 to 5 g/l, preferably 0.1 to 4 g/l.

Further, surface-active agents, such as alkylsulfonic acids, aliphatic acids, and aromatic carboxylic acids, may be added as needed.

The processing temperature using the color developer of this invention is between 20° to 50° C., preferably 30° to 40° C. The processing time is between 20 sec. to 5 min., preferably 30 sec. to 2 min.

The replenisher amount of color developer of the present invention is in the range of 20 to 120 ml, preferably 30 to 100 ml, per $m^2$ of photographic material. The term "replenisher amount" herein means the amount of the so-called color-developing replenisher to be supplied, excluding the amounts of additives for correcting the deterioration due to lapse of time or condensation.

The above-mentioned additives include, for example, water for diluting the condensated solution, preservatives susceptible to aging, or alkaline agents for raising up the pH-value.

Color developed photographic emulsion layer are usually bleached. Bleaching may be conducted separately or simultaneously with fixing process (bleach-fixing process). Further, in order to process rapidly, bleach-fixing process may be conducted after bleaching process. Also, processing using two bleach-fixing baths continuously connected, fixing process before bleach-fixing, or bleaching process after bleach-fixing may be effected according to the purpose. As bleaching agents, for example, compounds of polyvalent metals such as iron (III), cobalt (III), chromium (VI), and copper (II) and the like; peracids; quinones; and nitro compounds may be used. Typical examples of useful bleaching agents include ferricyanates; dichromates; organic complex salts of iron (III) or cobalt (III) such as complex salts with an aminopolycarboxylic acid (e.g., ethylenediaminetetraacetic acid, diethylenetriaminepentaacetic acid, cyclohexanediaminetetraacetic acid, methyliminodiacetic acid, 1,3-diaminopropanetetraacetic acid, glycoletherdiaminetetraacetic acid, or the like) or an organic acid (e.g., citric acid, tartaric acid, maleic acid, or the like); persulfates; bromates; permanganates; nitrosephenols, or the like. Of these, complex salts of iron (III) with aminopolycarboxylic acid including iron (III) ethylenediaminetetraacetate and persulfates are particularly preferable to achieve rapid processing and to prevent environmental pollution. Complex salts of iron (III) with aminopolycarboxylic acid are useful in bleaching solution, particularly in bleach-fixing solution. The pH-value of the bleaching solution or bleach-fixing solution using an iron (III) complex salts with aminopolycarboxylic acid is in the range of 5.5 to 8, although the processing can be conducted in lower range than the above to achieve rapid processing.

In the bleaching solution, the bleach-fixing solution, and their preceding bath solution various bleach-accelerator can be used if necessary. As specific examples of useful bleach-accelerator can be mentioned compounds having a mercapto group or a disulfido group described, for example, in U.S. Pat. No. 3,893,858, West German Patent No. 1,290,812, JP-A No. 95630/1978, and *Research Disclosure* No. 17,129 (July 1978), thiazoline derivatives described in JP-A No. 140129/1975, thiourea derivatives described in U.S. Pat. No. 3,706,561, iodide salts described in JP-A No. 16235/1983, polyoxyethylene compounds described in West German Patent No. 2,748,430, polyamine compounds described in JP-B No. 8836/1970, and bromide ion. Of these, in view of high acceleration effect, compounds having a mercapto group or a disulfido group are preferable, particularly preferably compounds described in U.S. Pat. No. 3,893,585, West German Patent No. 1,290,812, and JP-A No. 95630/1978. In addition, compounds described in U.S. Pat. No. 4,552,834 are also preferable. These bleach-accelerators may be added in the photographic material. These bleach-accelerators are used effectively in particular for bleach-fixing process of a color photographic material for photograph.

As fixing agents can be mentioned thiosulfate salts, thiocyanate salts, thioether-type compounds, thioureas, and many kinds of bromide salt. Of these, thiosulfate salts are used usually, and particularly ammonium thiosulfate can be used most widely. As a preservative for bleach-fixing solution sulfite salts, bisulfite salts, sulphinic acid- or carbonylbisulfuric acid-adducts are preferred.

The silver halide color photographic material of the present invention is generally passed through a washing step and/or a stabilizing step after the desilvering process. The amount of washing water in the washing step can be set in a wide range depending on the properties of the photographic material (for example, due to the material used, such as couplers), the uses of the photographic material, the temperature of the washing water, the number of washing tanks (number of washing steps), the type of replenishing mode, such as counter-current mode or concurrent mode, and other conditions. The relationship between the number of washing tanks and the amount of water in the multistage counter-current mode can be determined by a method described in *Journal of the Society of Motion Picture and Television Engineers.* Vol. 64, p. 248–253 (May, 1955).

With the multistage counter-current method described in the above-mentioned literature, the amount of washing water can be decreased considerably. However, bacteria propagate due to the increased time the water remains in the tanks, causing such problems as the adhesion of resulting suspended matter on the photographic material. To solve such problems in the present method of processing a color photographic material, a method of decreasing calcium and magnesium described in JP-A No. 288838/1987 can be used very effectively. Further, agents that can be used include isothiazolone and cyabendazole compounds described in JP-A No. 8542/1982, chlorine-type bactericides such as sodium chlorinated isocyanurate, benzotriazole, and other bactericides in Hiroshi Horiguchi Bokinbobai no Kagaku, Sakkin, Bobai Gijutsu, edited by Eiseigijutsu kai, and Bokinbobaizai Jiten, edited by Nihon Bokinbobai-gakkai.

The pH range of the washing water in the processing steps for the photographic material of the present invention may be 4 to 9, preferably 5 to 8. The temperature and time of washing, which can be set according to the use or property of the photographic material, is generally in the range 15° to 45° C. and 20 sec. to 10 min., preferably 25° to 40° C. and 30 sec. to 5 min. Further, the photographic materials of the present invention can be processed directly by a stabilizing solution without a washing step. In such a stabilizing process, all known methods described, for example, in JP-A Nos. 8543/1982, 14834/1983, and 220345/1985, can be used.

In some cases a stabilizing process is carried out following the above-described washing process, and an example of such cases is a stabilizing bath containing formalin and a surface-active agent for use as a final bath for color photographic materials for photographing. In this stabilizing bath various chelating agents or bactericides may be added.

The over-flowed solution accompanied by the above-described replenishing of washing water or stabilizing solution can e reused at desilvering step or so.

The silver halide color photographic material of the present invention may include a color developing agent for the sake of simplifying and quickening the developing process. For this purpose it is preferable to use a various precursor of color developing agent. As such precursors it can be mentioned, for example, indian aniline-series compounds described in U.S. Pat. No. 3,342,597, shiff base type compounds described in U.S. Pat. No. 3,342,599, *Research Disclosure* Nos. 14,850 and No. 15,159, aldol compounds described in *Research Disclosure* No. 13,942, complex salts of metal described in U.S. Pat. No. 13,942, complex salts of metal described in U.S. Pat. No. 3,719,492, and urethane compounds described in JP-A No. 135628/1978.

The silver halide color photographic material of the present invention may include each kind of 1-phenyl-3-pyrazilidone compounds for accelerating the color developing if needed. Examples of the compound are described in JP-A Nos. 64339/1981, 144547/1982, and 115438/1983.

In the present invention, each processing solution is used at a temperature of 10° to 50° C. Although it is used usually at a temperature of 33° to 38° C. as standards, it can be used at higher temperature than the above-mentioned in order to accelerate the processing so as to shorten the processing time, or conversely at lower temperature to achieve improvements of image quality and of stability of processing solution. Further, in order to save silver in the photographic material a processing using cobalt intensification described in West German Patent No. 2,226,770 and U.S. Pat. No. 3,674,499 or peroxide intensification.

The method according to the present invention can be adopted to the processing of a color paper, color reverse paper, or color direct positive paper.

Next, details of the silver halide color photographic material for use in the present invention will be described below.

The content ratio of silver chloride in the silver halide emulsion of the present invention is 80 mol % or more, preferably 95 mol % or more, more preferably 98 mol % or more. In view of rapid processing, the higher the content of silver chloride the more preferable. Small amounts of silver bromide and/or silver iodide may be contained in the high-silver chloride emulsion of the present invention. In these cases, many useful effects on photo-sensitivity can be obtained, to increase the amount of light-absorption, increase the adsorption of spectrally-sensitizing dye, and to decrease the desensitization due to spectrally-sensitizing dye. Preferably, the halogen composition of silver halide in total photographic emulsion layer is 80 mol % or over.

In the present invention, preferably the blue-sensitive layer, the green-sensitive layer and the red-sensitive layer are silver halide emulsion layers comprising high silver chloride emulsion.

The silver halide grains to be used in the present invention may be of such a structure that the internal phase differs from the surface (core/shell grain), they may be polyphase with a joining structure, the entire grains may have a uniform phase, or a mixture thereof.

The average size of the silver halide grains (expressed in terms of the grain diameter for spherical or semi-spherical grains, the edge length for cubic grains, and the spherical diameter for tabular grains, which can be determined as the average of the projected area diameter) is preferably smaller than 2 μm and larger than 0.1 μm, most preferably smaller than 1.5 μm and larger than 0.15 μm. The distribution of grain size may be either narrow or wide, but it is preferable in the present invention to use the so-called monodisperse emulsion of silver halide having a value (deviation coefficient) obtained by dividing the standard deviation calculated from the size distribution curve by the average grain size of 20% or less, most preferably 15% or less. In order to realize the gradation desired for the photographic material, two or more monodisperse silver halide emulsions (preferably all emulsions having the above-mentioned deviation coefficient) different in grain size may be mixed in a single layer or coated as different layers that have substantially the same color sensitivity. Further, two or more polydisperse silver halide emulsions or a combination of monodisperse and polydisperse emulsions can be employed as a mixture in one layer, or coated as different layers.

Silver halide grains for use in this invention may have a regular crystal structure such as cubic, hexahedral, rohmbic dodecahedral, or tetradecahedral, an irregular crystal structure such as spherical, or thereof composite crystal structure. Tabular grains may be employed wherein at least 50% of the total projected area of silver halide grains is tabular grains with a diameter-to-thickness ratio of about 5 or more, particularly of about 8 or more. Silver halide emulsions may be a mixture of various crystal structures. Silver halide grains may be used which form a latent image primary on the grain surface or in the interior of the grains.

In the present invention, the coating amount of silver halide is 1.5 g/m$^2$ or less, preferably 0.8 g/m$^2$ or less and 0.3 g/m$^2$ or more, in terms of silver. A coating amount of 0.8 g/m$^2$ or less is very preferable in view of rapidness and prevention for occurrence of suspended mater above described.

The photographic emulsion for use in the present invention can be prepared by the process described in *Research Disclosure* (RD) Vol. 176, Item No. 17643 (I, II, III)(Dec. 1978).

Generally the emulsion to be used in the present invention may be physically ripened chemically ripened, and spectrally sensitized. Additives that will be used in these steps are described in *Research Disclosure* Vol. 176, No. 17643 (Dec. 1978) and ibid. Vol. 187, No. 18716 (Nov. 1978), and the involved sections are listed in the Table below.

Known photographic additives that can be used in the present invention are also described in the above-mentioned two *Research Disclosures,* and the involved sections are listed in the same Table below.

| Additive | RD 17643 | RD 18716 |
|---|---|---|
| 1 Chemical sensitizer | p. 23 | p. 648 (right column) |
| 2 Sensitivity-enhancing agents | " | " |
| 3 Spectral sensitizers, | pp. 23–24 | pp. 648 (right column)–649 (right column) |
| 4 Supersensitizers | | |
| 5 Brightening agents | p. 24 | — |
| 6 Coupler | p. 25 | |
| 7 Organic solvent | p. 25 | |
| 8 Light absorbers,and Filter dyes | pp. 25–26 | pp. 649 (right column)–650 (right column) |
| 9 UV absorbers | | |
| 10 Stain-preventive agents | p. 25 (right | p. 650 (left to right (column) |

-continued

| Additive | RD 17643 | RD 18716 |
|---|---|---|
| | column) | |
| 11 Image-dye stabilizers | p. 25 | — |
| 12 Hardeners | p. 26 | p. 651 (left column) |
| 13 Binders | p. 26 | " |
| 14 Plasticizers and Lubricants | p. 27 | p. 650 (right column) |
| 15 Coating aids and Surface-active agents | pp. 26–27 | " |
| 16 Antistatic agents | p. 27 | " |

Various color couplers can be used in the present invention. Herein the term "color coupler" means a compound which can form dye by a coupling reaction with an oxidized aromatic primary amine developing agent. Typical and useful color couplers are naphthol or phenol compounds, pyrazolone or pyrazoloazol compounds, and open chain or heterocyclic ketomethylene compounds. Examples of these cyan, magenta and yellow couplers are disclosed in patents cited in *Research Disclosure* (RD) No. 17643 (Dec. 1978), VII-D and ibid. No. 18717 (Nov. 1979).

Color couplers for incorporation in the present photographic materials are preferably nondiffusible by being ballasted or polymerized. Two-equivalent couplers with a coupling-off group at the coupling-active position are more preferable than four-equivalent couplers having only hydrogen at the coupling position, in view of reduced silver coverage. Couplers can be employed in the present invention which form a dye of controlled image smearing or a colorless compound, as well as DIR couplers which release a development inhibiting reagent upon a coupling reaction, and couplers releasing a development accelerating agent.

Representative examples of yellow couplers useful in this invention include couplers of the oil-protected acylacetoamide type, as illustrated in U.S. Pat. Nos. 2,407,210, 2,875,057, and 3,265,506. Typical examples of two-equivalent yellow couplers preferable in this invention include yellow couplers having an oxygen-linked coupling-off group as illustrated in U.S. Pat. Nos. 3,408,194, 3,447,928, 3,933,501, and 4,022,620; yellow couplers having a nitrogen-linked coupling-off group as illustrated in JP-B No. 10739/1983, U.S. Pat. Nos. 4,401,752 and 4,326,024, Research Disclosure No. 18053 (April 1979), British Patent No. 1,425,020 and German Patent (OLS) Nos. 2,219,917, 2,261,351, and 2,433,812. Couplers of the α-pivaloyl-acetoanilide type are superior in the fastness of formed dye, particularly on exposure to light, while couplers of the α-benzoylacetoanilide type are capable of forming high maximum density.

Of these, acetoamide derivertives such as benzoyl acetoanilide and pivaloy acetoanilide are preferable.

In particular, compounds represented by the following formulae (Y-1) and (Y-2) are preferable as a yellow coupler:

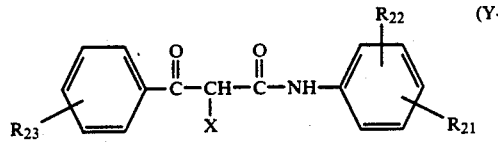

(Y-1)

-continued

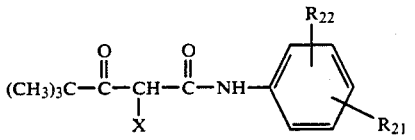

(Y-2)

wherein X represents a hydrogen atom or coupling split-off group (particularly nitrogen split-off groups are preferable than oxygen split-off groups); $R_{21}$ represents a diffusion-resist group having totally 8 to 32 carbon atoms; $R_{22}$ represents a hydrogen atom, one or more halogen atoms, a lower alkyl group, a lower alkoxy group, or a diffusion-resist group having totally 8 to 32 carbon atoms; $R_{23}$ represents a hydrogen atom or a substituent; and when $R_{22}$ is two or more in number they may be the same or different.

Details of pyvaloyl acetoanilide-type yellow couplers are described, for example, in U.S. Pat. Nos. 4,622,287 (from column 3 line 15 to column 8 line 39 of the specification) and 4,623,616 (from column 14 line 50 to column 19 line 41).

Details of benzoyl acetoanilide-type yellow couplers are described, for example, in U.S. Pat. Nos. 3,408,194, 3,933,501, 4,046,575, 4,133,958, and 4,401,752.

Magenta couplers useful for this invention include oil-protected couplers of the indazolone or cyanoacetyl type, preferable of the 5-pyrazolone or pyrazoloazole (e.g., pyrazolotriazole) type. 5-Pyrazolones substituted by an arlamino or acylamino group at the 3-position are preferable in view of the hue and maximum densitives of the formed dyes, and they are illustrated in U.S. Pat. Nos. 2,311,082, 2,343,703, 2,600,788, 2,908,573, 3,062,653, 3,152,896, and 3,936,015. Preferable coupling-off groups in the two-equivalent 5-pyrazolone couplers are nitrogen-linked coupling-off groups described in U.S. Pat. No. 4,310,619, and an arylthio group described in U.S. Pat. No. 4,351,897. The ballast groups described in European Patent No. 73,636 have effects to enhance developed density in the 5-pyrazolone couplers.

Examples of pyrazoloazole couplers include pyrazolobenzimidazole described in U.S. Pat. No. 3,369,897, more preferably pyrazolo[5,1-c][1,2,4]triazoles described in U.S. Pat. No. 3,725,067, pyrazolotetrazoles described in *Research Disclosure,* No. 24220 (June 1984), and pyrazolopyrazole described in *Research Disclosure,* No. 24230 (June 1984). Imidazo[1,2-b]pyrazoles, described in European Patent No. 119,741, are preferable, and pyrazolo [1,5-b][1,2,4]triazoles, described in European Patent No. 119,860, are particularly preferable with respect to the reduced yellow side-absorption and fastness of the developed dyes on exposure to light.

Cyan couplers that can be used in this invention include naphthol couplers and phenol couplers of the oil-protected type. An example of a naphthol coupler is that disclosed in U.S. Pat. No. 2,474,293, and preferred examples of naphthol couplers are such two-equivalent naphthol couplers as the oxygen atom splitting-off type disclosed in U.S. Pat. Nos. 4,052,212, 4,146,396, 4,228,233, and 4,296,200. Examples of phenol couplers are those disclosed in U.S. Pat. Nos. 2,369,929, 2,801,171, 2,772,162, and 2,895,826. Examples of cyan couplers stable to moisture and heat that can be advantageously used in this invention include phenol cyan couplers having a higher alkyl group than methyl group at the meta position of the phenol nucleus, as disclosed in U.S. Pat. No. 3,772,002, 2,5-diacylamino-substituted phenol cyan couplers disclosed in U.S. Pat. No. 2,772,162, 3,758,308, 4,126,396, 4,334,011, and 4,327,173, German Patent (OLS) No. 3,329,729 and JP-B No. 42671/1983, and phenol cyan couplers having a phenylureido group at the 2-position and an acylamino group at the 5-position disclosed in U.S. Pat. Nos. 3,446,622, 4,333,999, 4,451,559, and 4,427,767.

It is possible to improve the graininess by using color couplers in combination with a coupler that forms a dye with a proper degree of diffusion. A magenta coupler of such dye-diffusing type is disclosed in U.S. Pat. No. 4,366,237 and British Patent No. 2,125,570; and a similar type or yellow, magenta, or cyan coupler is disclosed in European Patent No. 96,570 and German Patent (OLS) No. 3,234,533.

The dye-forming couplers and the special couplers described above may be dimeric, oligomeric, or polymeric. Examples of polymerized dye-forming couplers are disclosed in U.S. Pat. Nos. 3,451,820 and 4,080,211. Examples of polymerized magenta couplers are disclosed in British Patent No. 2,102,173 and U.S. Pat. No. 4,367,282.

In order to satisfy the characteristics desired for the photographic materials, various couplers used in the present invention can be employed as a combination of two or more couplers in a light-sensitive layer, or the same compound can be employed in two or more layer.

The couplers to be used in the present invention can be incorporated to photographic materials by various known dispersing processes. Examples of high-boiling organic solvents for use in the oil-in-water dispersing process are described in U.S. Pat. No. 2,322,027. The steps and effect of the latex dispersion method and examples of latex for impregnation are described in U.S. Pat. No. 4,199,363 and German Patent Application (OLS) Nos. 2,541,274 and 2,541,230.

Usually the color couplers are used in an amount of 0.001 to 1 mol per mol of photosensitive silver halides. The preferred amounts of coupler are 0.01 to 0.5 mol for yellow coupler, 0.003 to 0.3 mol for magenta coupler, and 0.02 to 0.3 mol for cyan coupler.

The photographic materials to be used in the present invention are those applied on usual flexible bases such as plastics films (e.g., cellulose nitrate, cellulose acetate, or polyethyleneterephtalate), paper, or on a rigid base, such as a glass plate. Details of the base and the method of application are described in Research Disclosure, Item 17643, XV (p. 27) and XVII (p. 28)(Dec. 1978).

In this invention a reflective base may be preferably used. The "reflective base" can increase the reflectivity and make clear the dye image formed in a silver halide emulsion layer. Such a reflective base includes a base coated with a hydrophobic resin that contains a light reflecting material such as titanium oxide, zinc oxide, calcium carbonate, and calcium sulfate.

The invention will now be described in further detail with reference to examples, but the invention is not limited to the following examples.

Example 1

A multilayer color photographic paper A was prepared by coating layers as hereinbelow described on a paper laminated on both sides with polyethylene.

Coating solutions were prepared by mixing and dissolving an emulsion, each of chemicals, and an emulsified dispersion, of which each preparation procedure is described below.

Preparation of the coupler emulsion

To a mixture of 19.1 g of yellow coupler (ExY) and 4.4 g of an image-dye stabilizer (Cpd-1), 17.2 ml of ethyl acetate and 7.7 g of a solvent (Solv-1) were added and dissolved. The resulting solution was emulsified and dispersed in 185 ml of 10% gelatin solution containing 8 ml of sodium dodecylbenzensulfonate.

According to this procedure each emulsion of magenta coupler, cyan coupler, and intermediate layer was prepared.

The compounds used for each emulsion were as follows:

Yellow coupler (ExY)

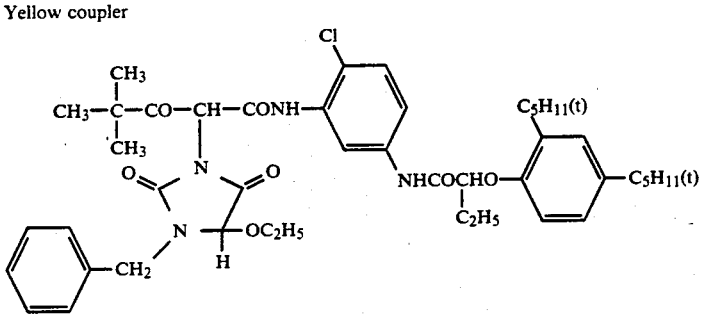

Magenta coupler (ExM)

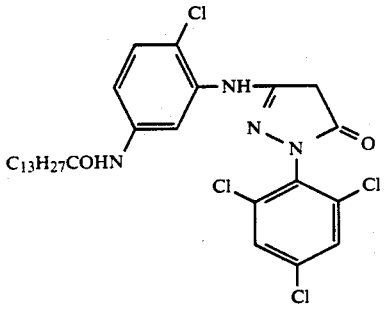

(ExC1)

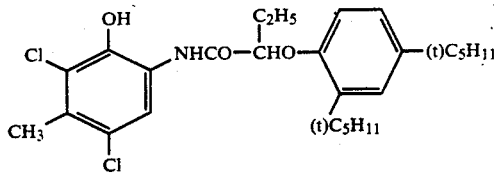

(ExC2)

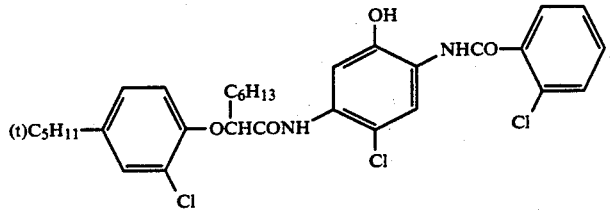

(ExC4)

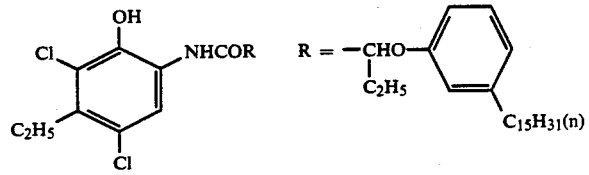

The same as ExC4, except that R = $C_{15}H_{31}$, (ExC5)

Image-dye stabilizer

-continued
(Cpd-1)
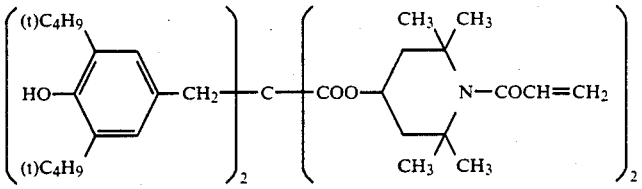
Color-mix inhibitor (Cpd-2)
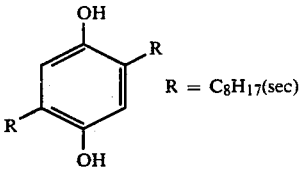
(Cpd-3)
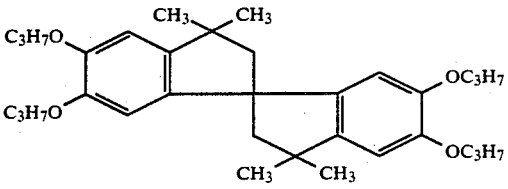
(Cpd-4)
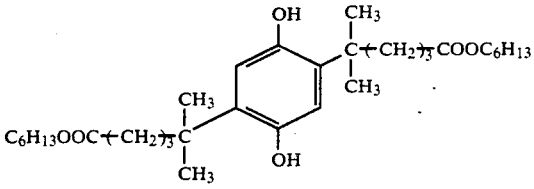
Color-mix inhibitor
The same as (Cpd-2), except that R = $C_8H_{17}$(t) (Cpd-5)
Image-dye stabilizer
6a:6b:6c = 5:8:9 (in weight ratio) (Cpd-6)
6a
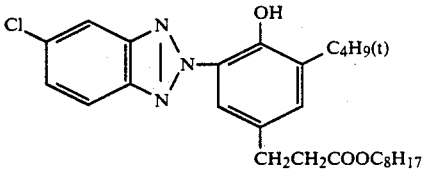
6b
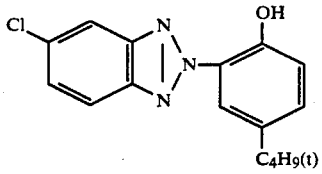
6c
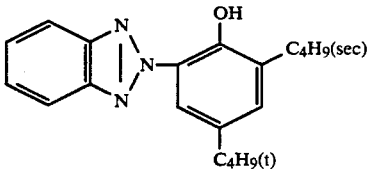
Polymer
$\leftarrow CH_2-CH\rightarrow_n$ (av. molecular weight: 80,000) (Cpd-7)
$CONHC_4H_9(t)$
UV absorber
Cpd-6a:6b:6c = 2:9:8 (in weight ratio) (UV-1)
Solvent -continued

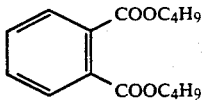

(Solv-1)

Solvent
$O{=}P{+}O{-}C_8H_{17})_3$ (Solv-2)

Solvent
$O{=}P{+}O{-}C_9H_{19}(iso))_3$ (Solv-3)

Solvent (Solv-4)

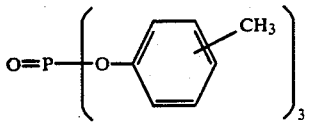

The following dyes were used to prevent the respective emulsion layer from irradiation.

Red-sensitive emulsion layer: Dye-R

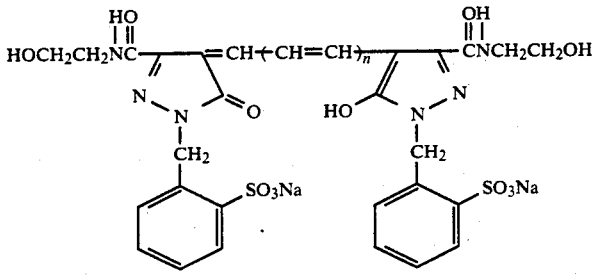

wherein n = 2

Green-sensitive emulsion layer:

The same as Dye - R, except that n = 1

To the red-sensitive emulsion layer, the following compound was added in an amount of $2.6\times10^{-3}$ mol per mol of silver halide.

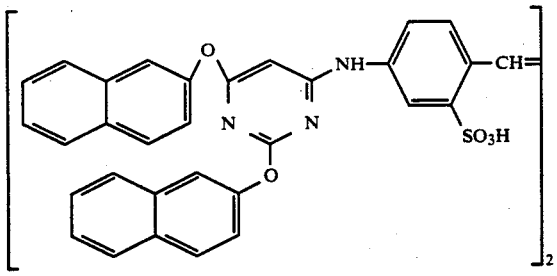

Next, the preparation procedure of emulsions used in this Example will be described below.

Blue-sensitive Emulsion: A monodisperse silver chloride emulsion of cubic crystalline grains (containing $K_2IrCl_6$ and 1,3-dimethylimidazoline-2-thione) having an average grain size of 1.1 μm, and a deviation coefficient (the value obtained by dividing the standard deviation by average grain size=s/d) of 0.10 was prepared in the usual way. To 1.0 kg of the thus-prepared emulsion was added 26 ml of a 0.6% solution of a blue spectral sensitizing dye (S-1), and an emulsion of 0.05 μm silver bromide fine grains was further added thereto in a ratio of 0.5 mol % with respect to the host silver chloride emulsion. After ripening, sodium thiosulfate was then achieved, and a stabilizer (see Table 1) was added thereto in a proportion of $10^{-4}$ mol per mol of Ag in order to prepare a blue-sensitive emulsion.

Green-sensitive Emulsion: Silver chloride grains containing $K_2IrCl_6$ and 1,3-dimethylimidazoline-2-thione were prepared in the usual way, and a sensitizing dye (S-2) was added thereto in a ratio of $4\times10^{-4}$ mol per mol of Ag. KBr was further added thereto, and after ripening, sodium thiosulfate was added thereto and optimum chemical sensitization was then achieved. A stabilizer (see Table 1) was added thereto in a ratio of $5\times10^{-4}$ mol per mol of Ag in order to prepare a monodisperse cubic silver chloride emulsion having an average grain size of 0.48 μm and a deviation coefficient of 0.10.

Red-sensitive Emulsion: An emulsion was prepared by repeating the same procedure for the green-sensitive emulsion, except that the sensitizing dye was changed to dye (S-3) in an additive amount of $1.5\times10^{-4}$ mol per mol of silver halide.

The compounds used are shown below.

(S-1) Sensitizing dye

-continued

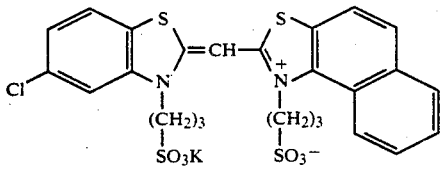

(S-2) Sensitizing dye

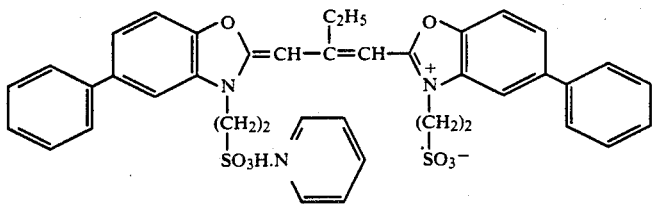

(S-3) Sensitizing dye

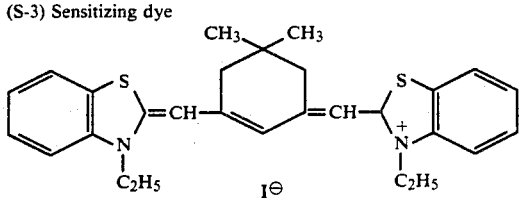

(Stb-1) Stabilizer

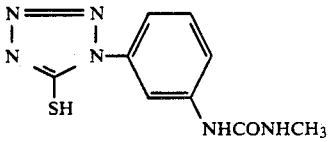

Compositions of layers

The compositions of the layers were as follows. The values represent the coating amount in g/m$^2$. The amount of each silver halide emulsion is represented by the coating amount in terms of silver.

| | |
|---|---|
| Base: | |
| Polyethylene-laminated paper (a white pigment, $TiO_2$, and a bluish dye, ultramarine, were included in the polyethylene film of the first layer side) | |
| First layer: Blue-sensitive emulsion layer | |
| Silver halide emulsion | 0.25 |
| Gelatin | 1.86 |
| Yellow coupler (ExY) | 0.82 |
| Image-dye stabilizer (Cpd-1) | 0.19 |
| Solvent (Solv-1) | 0.35 |
| Second layer: Color-mix-preventing layer | |
| Gelatin | 0.99 |
| Color-mix inhibitor (Cpd-2) | 0.08 |
| Third layer: Green-sensitive emulsion layer | |
| Silver halide emulsion | 0.31 |
| Gelatin | 1.24 |
| Magenta coupler (ExM) | 0.60 |
| Image-dye stabilizer (Cpd-3) | 0.25 |
| Image-dye stabilizer (Cpd-4) | 0.12 |
| Solvent (Solv-2) | 0.42 |
| Fourth layer: Ultraviolet-absorbing layer | |
| Gelatin | 1.58 |
| Ultraviolet absorbent (UV-1) | 0.62 |
| Color-mix inhibitor (Cpd-5) | 0.05 |
| Solvent (Solv-3) | 0.24 |
| Fifth layer: Red-sensitive emulsion layer | |
| Silver halide emulsion | 0.21 |
| Gelatin | 1.34 |
| Cyan coupler (a blend of ExC1 and ExC2 in a ratio of 1:1) | 0.34 |

-continued

| | |
|---|---|
| Image-dye stabilizer (Cpd-6) | 0.17 |
| Polymer (Cpd-7) | 0.40 |
| Solvent (Solv-4) | 0.23 |
| Sixth layer: Ultraviolet-absorbing layer | |
| Gelatin | 0.53 |
| Ultraviolet absorbent (UV-1) | 0.21 |
| Solvent (Solv-3) | 0.08 |
| Seventh layer: Protective layer | |
| Gelatin | 1.33 |
| Acrylic-modified (modification degree: 17%) copolymer of poly(vinyl alcohol) | 0.17 |
| Liquid paraffin | 0.03 |

The sodium salt of 1-oxy-3,5-dichloro-s-triazine was used as a hardening agent for each layer.

Samples B to G were prepared in the same manner as Sample A except that the stabilizing agent was changed as shown in Table 1, respectively.

TABLE 1

| Sample | A | B | C | D | E | F | G |
|---|---|---|---|---|---|---|---|
| Stabilizer | — | XVIII-1 | XVIII-2 | XVIII-3 | I-27 | I-45 | I-46 |

TABLE 1-continued

| Sample | A | B | C | D | E | F | G |
|---|---|---|---|---|---|---|---|
| Amount | — | | $10^{-4}$ mol/mol of Ag | | | | |

(XVIII-1)

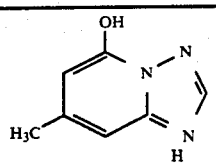

(XVIII-2)

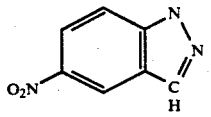

(XVIII-3)

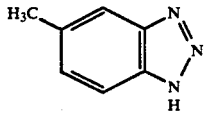

These coated samples were subjected to the following experiment to evaluate their photographic characteristics.

First, each of the coated samples was subjected to a gradational exposure of light for a sensitometry using a sensitometer (FWH-type, made by Fuji Photo Film Co., Ltd., color temperature at light source: 3200K). The exposure was conducted to give an exposure time of one-tenth second and an exposure amount of 250 CMS.

Thereafter they were subjected to continuous processing (running test) according to the processing steps described below using the processing solutions described below until the color-developer volume replenished is twice as much as the tank volume. The composition of the color-developer was changed as shown in Table 2, and each developer was subjected to the running test.

| Processing step | Temperature (°C.) | Time (sec.) | Replenisher Amount (ml)* | Tank (l) |
|---|---|---|---|---|
| Color-developing | 38 | 45 | 80 | 8 |
| Bleach-fixing | 30–36 | 45 | 161 | 8 |
| Rinsing ① | 30–37 | 20 | — | 4 |
| Rinsing ② | 30–37 | 20 | — | 4 |
| Rinsing ③ | 30–37 | 20 | — | 4 |
| Rinsing ④ | 30–37 | 20 | 200 | 4 |
| Drying | 70–80 | 60 | | |

*Replenisher amount per $m^2$ of photographic material (Rinsing steps were carried out in a four-tank cascade mode from tank of rinsing ④ toward tank of rinsing ①.)

The composition of the processing solutions were as follows:

| | Tank solution | Replenisher |
|---|---|---|
| Color-Developing Solution | | |
| Water | 800 ml | 800 ml |
| Benzyl alcohol | See Table 2 | |
| Ethylenediamine-N,N,N,N-tetramethylenephosphonate | 3.0 g | 6.0 g |
| Organic preservative A (II-1) | 0.03 mol | 0.07 mol |
| Sodium chloride | 4.2 g | 0.0 g |
| Potassium carbonate | 25 g | 25 g |
| N-Ethyl-N-(β-methanesulfonamidoethyl)-3-methyl-4-aminoaniline sulfate | 5.0 g | 11.0 g |
| Organic preservative B (VIII-1) | 0.05 mol | 0.07 mol |
| Fluorescent brightening agent (4,4-diaminostilbene series) | 2.0 g | 4.0 g |
| Water to make | 1000 ml | 1000 ml |
| pH (25° C.) | 10.05 | 10.85 |
| Bleach-Fixing Solution (Both the tank solution and replenisher are the same) | | |
| Water | | 400 ml |
| Ammonium thiosulfate (70%) | | 100 ml |
| Sodium sulfite | | 17 g |
| Iron (III) ammonium ethylenediaminetetraacetate | | 55 g |
| Disodium ethylenediaminetetraacetate | | 5 g |
| Ammonium bromide | | 40 g |
| Glacial acetic acid | | 9 g |
| Water to make | | 1000 ml |
| pH (25° C. ) | | 5.40 |
| Rinsing Solution (Both the tank solution and replenisher are the same) | | |
| Ion-exchanged water | (each content of calcium and magnesium was 3 ppm or less) | |

At the beginning and the end of the running test, each sample was subjected to the above-described sensitometry, and then the minimum densities (Dmin) and the maximum densities (Dmax) of blue (B), and the sensitivity (log E at density 0.5) were determined by using a Macbeth densitometer. The results are shown in Table 2. In the Table, + represents the increase of sensitibity and − represents the decrease of sensitivity.

At the same time, the existence of suspended matters in the color developing solution after the running test was evaluated by visual inspection. The results are shown in Table 2.

TABLE 2

| Processing Process | ① | ② | ③ | ④ | ⑤ | ⑥ | ⑦ | ⑧ | ⑨ |
|---|---|---|---|---|---|---|---|---|---|
| Photographic Material | A | B | B | C | D | E | F | G | G |
| Benzyl alcohol (ml/l) | | | | | | | | | |
| Tank solution | — | — | 14.0 | — | — | — | — | — | 14.0 |
| Replenisher | — | — | 35.0 | — | — | — | — | — | 35.0 |
| Remarks | | | Comparative Example | | | | This Invention | | Comparative Example |
| BL Δmin | +0.26 | +0.03 | +0.16 | +0.02 | +0.01 | +0.01 | 0 | 0 | +0.11 |
| BL Δmax | −0.14 | −0.36 | −0.28 | −0.30 | −0.38 | −0.05 | −0.02 | −0.01 | −0.06 |
| BL ΔSensitivity | −0.04 | −0.14 | −0.12 | −0.12 | −0.16 | −0.04 | 0 | −0.01 | −0.06 |
| Suspended Matter* | XX | XX | XX | XX | XX | Δ | ○ | ○ | X |

*Suspended Matter:
○ . . . None
Δ . . . Found a little
X . . . Found
XX . . . Found many As is apparent from the results in Table 2, when a photographic material not containing the compound represented by formula (I) was used, or when a color developer containing benzyl alcohol was used, as shown in the processing processes (1) to (5) and (9), there were large changes in the photographic characteristics from the beginning to the end of the running test, and a large amount of suspended matter which seemed to be silver eluted from the photographic material was observed in the color developer after running test.

However, when a photographic material containing the compound represented by formula (I) of the present invention was used, and further a color developer not containing benzyl alcohol was used, as shown in the processing processes (6) to (8), the changes in the photographic characteristics during the running test were apparently decreased, and no suspended matter as described above appeared after the running test.

Thus according to the present invention it becomes to be possible to decrease greatly the replenisher amount of developer without marring the rapidness of the process.

Example 2

When a process was repeated in the same manner as in Example 1, except that I-45 of the photographic material F in the processing process (7) was changed to I-10, I-11, I-14, I-22, I-28, and I-47, respectively, the same preferable results were obtained in all cases.

Example 3

The similar photographic materials A to G as in Example 1 were subjected to a continuous processing (running test) in the processing steps described below using processing solutions of which composition are described below, until the replenisher-amount of developing solution comes to twice the volume of color-developing tank, provided that the composition of color developing solution was changed as shown in Table 3.

| Processing step | Temperature (°C.) | Time (sec.) | Replenisher Amount (ml)* | Tank (l) |
|---|---|---|---|---|
| Color-developing | 38 | 50 | 70 | 8 |
| Bleach-fixing | 30–36 | 45 | 161 | 8 |
| Rinsing (1) | 30–37 | 20 | — | 4 |
| Rinsing (2) | 30–37 | 20 | — | 4 |
| Rinsing (3) | 30–37 | 20 | — | 4 |
| Rinsing (4) | 30–37 | 30 | 200 | 4 |
| Drying | 70–80 | 60 | | |

*Replenisher amount per $m^2$ of photographic material (Rinsing steps were carried out in a four-tank cascade mode from tank of rinsing (4) toward tank of rinsing (1).)

The composition of the processing solutions were as follows:

| | Tank solution | Replenisher |
|---|---|---|
| Color-Developing Solution | | |
| Water | 800 ml | 800 ml |
| Ethylenediamine-N,N,N,N-tetramethylenephosphonate | 3.5 g | 7.0 g |
| Organic preservative A | 0.04 mol | 0.08 mol |
| Sodium chloride | 5.0 g | 0.0 g |
| Potassium carbonate | 25 g | 25 g |
| N-Ethyl-N-(β-methanesulfonamidoethyl)-3-methyl-4-aminoaniline sulfate | 5.0 g | 11.0 g |
| Organic preservative B | 0.06 mol | 0.08 mol |
| Fluorescent whitening agent (4,4-diaminostilbene series) | 2.0 g | 4.0 g |
| Sodium sulfite | see Table 3 | |
| Water to make | 1000 ml | 1000 ml |
| pH (25° C.) | 10.05 | 10.90 |
| Bleach-Fixing Solution | | |
| The same as in Example 1 | | |
| Rinsing Solution | | |
| The same as in Example 1 | | |

At the beginning and the end of the running test, each sample was subjected to the above-described sensitometry, and then the changes of the minimum density (Dmin) and the maximum density (Dmax) of blue (B), and the sensitivity (log. E at density 0.5) due to the continuous process were determined using a Macbeth densitometer. The results are shown in Table 2. In the Table, + represents the increase of sensitibity, and − represents the decrease of sensitivity.

At the same time, the existence of suspended matters in the color-developing solution after the running test was evaluated by visual inspection. The results are shown in Table 3.

TABLE 3

| Processing Process | (1) | (2) | (3) | (4) | (5) | (6) | (7) | (8) | (9) |
|---|---|---|---|---|---|---|---|---|---|
| Photographic Material | A | B | C | D | F | F | F | G | G |
| Sodium sulfite (ml/l) | | | | | | | | | |
| Tank solution | 2.0 | — | — | — | — | 0.5 | — | — | — |
| Replenisher | 4.3 | — | — | — | — | 1.2 | — | — | — |
| Organic Preservative A | Hydroxylamine | II-1 | II-I | II-I | II-I | II-I | IV-19 | Hydroxylamine | IV-21 |
| Organic Preservative B | — | VIII-1 | — | VIII-1 | VIII-1 | VIII-1 | VIII-1 | VIII-1 | XVII-7 |
| Remarks | Comparative Example | | | | This Invention | | | | |
| BL Δmin | +0.09 | +0.03 | +0.02 | +0.01 | +0.01 | 0 | 0 | 0 | 0 |
| BL Δmax | −0.51 | −0.39 | −0.35 | +0.40 | 0 | −0.07 | −0.01 | −0.04 | −0.01 |
| BL ΔSensitivity | −0.19 | −0.16 | −0.14 | −0.19 | 0 | −0.03 | 0 | −0.02 | 0 |
| Suspended Matter* | XX | XX | XX | XX | ○ | Δ | ○ | Δ | ○ |

*Suspended Matter:
○ . . . None
Δ . . . Found a little
XX . . . Found many

As is apparent from the results in Table 3, when a photographic material (A) not containing the compound represented by formula (I) was used, as shown in the processing process (1), there were large changes in minimum density, maximum density and sensitivity from the beginning to the end of the running test, and a large amount of suspended matter which seemed to be silver eluted from the photographic material was observed in the color developer after running test.

However, when photographic materials F and G containing the compound represented by formula (I) of the present invention were used, as shown in the processing processes (5) to (9), the changes in minimum density, maximum density and sensitivity during the running test were apparently decreased, and the suspended matter did not almost appear. As such conditions were much improved, compared those of processing processes (1) and (2). It is understood that the developer not containing sulfite ion and hydroxylamine is more preferable in the present invention, and to contain a compound II-1, IV-19, or IV-21 as an organic preservative A and a compound VIII-1 or VII-7 as an organic preservative B is particularly preferable, because, in the case of processing processes (5), (7) and (9), the changes of minimum density, maximum density and sensitivity were smaller and the above-described suspended matter did not appear.

Example 4

When a process was repeated in the same manner as in Example 3, except that the compound II-1 in the processing process (5) was changed to V-5, VI-1 and VII-5, respectively, the same preferable results were obtained in all cases. Further, when the compound VIII-1 in the processing process (7) was changed to IX-5, IX-8, X-1, X-3, XI-1, XI-3, XII-1, XII-2, XIII-3, XIII-10, XIV-8, XV-1, XVI-1, XVI-6 and XVII-1, respectively, the same preferable results were obtained.

Example 5

Multilayer color photographic papers A, B, C, and D were prepared with layers as hereinbelow described on each paper laminated on both sides with polyethylene. Coating solutions were prepared as follows:

Preparation of the first-layer coating solution

To a mixture of 19.1 g of yellow coupler (ExY-1) and 4.4 g of an image-dye stabilizer (Cpd-1), 27.2 ml of ethyl acetate and 7.7 ml (8.0 g) of a high boiling solvent (Solv-1) were added and dissolved. The resulting solution was emulsified and dispersed in 185 ml of 10% aqueous gelatin solution containing 8 ml of a 10% solution of sodium dodecylbenzensulfonate. Each of emulsions EM7 and EM8 was mixed with the above-obtained emulsified and dispersed solution and dissolved, and the concentration of gelatin in the mixture was adjusted to obtain the composition shown below, thereby preparing the first-layer coating solution. The second to the seventh-layer coating solutions were prepared in the same manner as the first coating solution. As a gelatin hardener for the respective layers, the sodium salt of 1-oxy-3,5-dichloro-2-triazine was used. As a thickener, a compound (Cpd-2) was used.

Compositions of layers

The composition of each layer is shown below. Each ingredient is indicated in g/m$^2$ of a coating amount, but the coating amount of silver halide is shown in g/m$^2$ in terms of silver.

| | |
|---|---|
| Supporting base: Polyethylene-laminated paper (a white pigment, $TiO_2$, and a bluish dye, ultramarine, were included in the first-layer side of the polyethylene-laminated film). | |
| First layer: Blue-sensitive layer | |
| Monodisperse silver chlorobromide emulsion (EM7) spectral-sensitized by sensitizing dye (ExS-1) | 0.15 |
| Monodisperse silver chlorobromide emulsion (EM8) spectral-sensitized by sensitizing dye (ExS-1) | 0.15 |
| Gelatin | 1.86 |

-continued

| | |
|---|---|
| Yellow coupler (ExY-1) | 0.82 |
| Image-dye stabilizer (Cpd-2) | 0.19 |
| Solvent (Solv-1) | 0.35 |
| Second layer: Color-mix-preventing layer | |
| Gelatin | 0.99 |
| Color-mix inhibitor (Cpd-3) | 0.08 |
| Third layer: Green-sensitive emulsion layer | |
| Monodisperse silver chlorobromide emulsion (EM9) spectral-sensitized by sensitizing dye (ExS-2, -3) | 0.12 |
| Monodisperse silver chlorobromide emulsion (EM10) spectral-sensitized by sensitizing dye (ExS-2, -3) | 0.24 |
| Gelatin | 1.24 |
| Magenta coupler (ExM-1) | 0.39 |
| Image-dye stabilizer (Cpd-4) | 0.25 |
| Image-dye stabilizer (Cpd-5) | 0.12 |
| Solvent (Solv-2) | 0.25 |
| Fourth layer: UV-absorbing layer | |
| Gelatin | 1.60 |
| UV absorbent (Cpd-6/Cpd-7/Cpd-8 = 3/2/6 in wt. ratio) | 0.70 |
| Color-mix inhibitor (Cpd-9) | 0.05 |
| Solvent (Solv-3) | 0.42 |
| Fifth layer: Red-sensitive emulsion layer | |
| Monodisperse silver chlorobromide emulsion (EM11) spectral-sensitized by sensitizing dye (ExS-4, -5) | 0.07 |
| Monodisperse silver chlorobromide emulsion (EM12) spectral-sensitized by sensitizing dye (ExS-4, -5) | 0.16 |
| Gelatin | 0.92 |
| Cyan coupler (ExC-1) | 1.46 |
| Cyan coupler (ExC-2) | 1.84 |
| Image-dye stabilizer (Cpd-7/Cpd-8/Cpd-10 = 3/4/2 in wt. ratio) | 0.17 |
| Polymer for dispersion (Cpd-11) | 0.14 |
| Solvent (Solv-1) | 0.20 |
| Sixth layer: UV-absorbing layer | |
| Gelatin | 0.54 |
| UV absorbent (Cpd-6/Cpd-8/Cpd-10 = 1/5/3 in wt. ratio) | 0.21 |
| Solvent (Solv-4) | 0.08 |
| Seventh layer: Protective layer | |
| Gelatin | 1.33 |
| Acryl-modified copolymer of poly(vinyl alcohol) (modification degree: 17%) | 0.17 |
| Liquid paraffin | 0.03 |

For preventing irradiation, dyes (Cpd-12 and -13) were used.

In addition, Alkanol XC (tradename, made by Dupont) and sodium alkylbenzensulfonate were used as auxiliary agents for emulsification and dispersion, and succinate ester and Magnefac F-120 (tradename, made by Dainippon Ink) were added to each layer as coating aids. Further, Cpd-14 and Cpd-15 were used as stabilizers for the layers containing silver halide.

The silver halide emulsions used in this Example were as follows:

| Emulsion | Shape | Grain size (μm) | Br Content (mol %) | Deviation coefficient* |
|---|---|---|---|---|
| EM7 | Cubic | 1.1 | 1.0 | 0.10 |
| EM8 | Cubic | 0.8 | 1.0 | 0.10 |
| EM9 | Cubic | 0.45 | 1.5 | 0.09 |
| EM10 | Cubic | 0.34 | 1.5 | 0.09 |
| EMll | Cubic | 0.45 | 1.5 | 0.09 |
| EM12 | Cubic | 0.34 | 1.6 | 0.10 |

*The values show distribution degree of grains as follows: standard deviation/av. grain size The chemical formulas of compounds used are as follows:

ExY-1
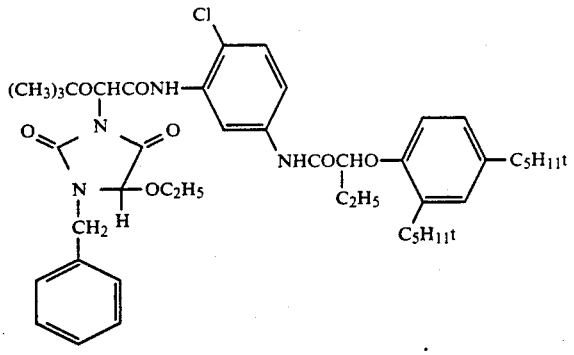
ExM-1
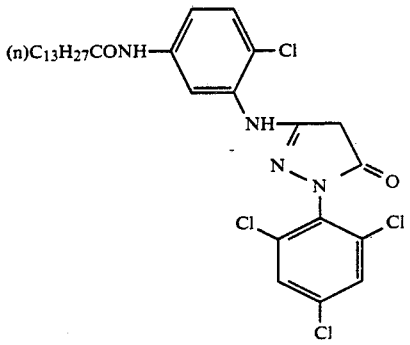
ExC-1
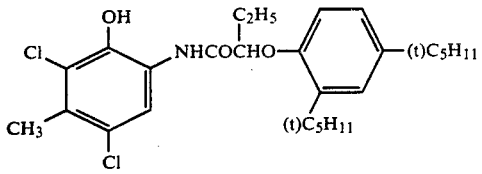
ExC-2
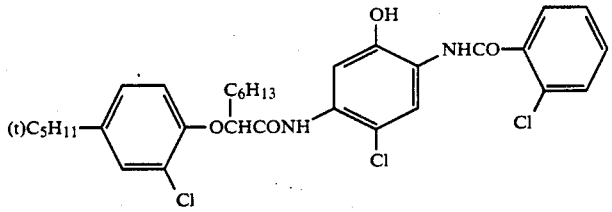
ExS-1
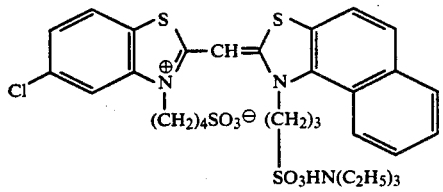
ExS-2
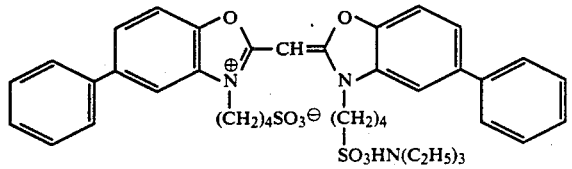

-continued
ExS-3
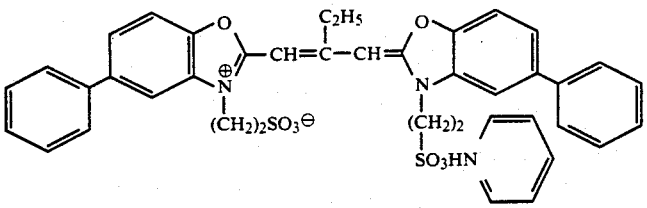
ExS-4
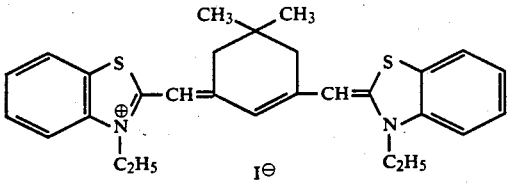
ExS-5
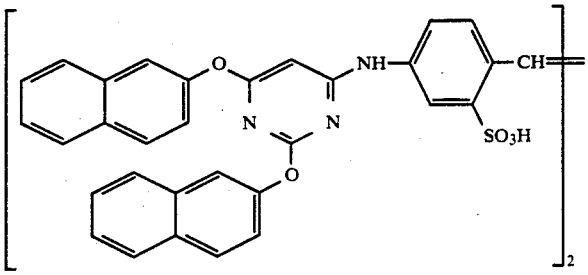
Cpd-1
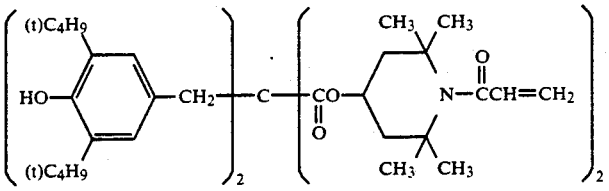
Cpd-2
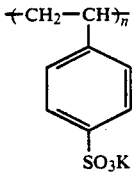
Cpd-3
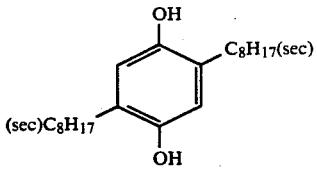
Cpd-4
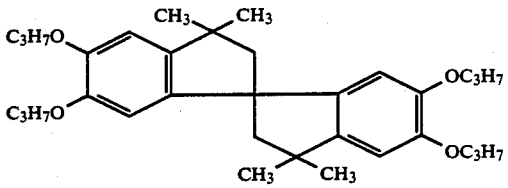
Cpd-5
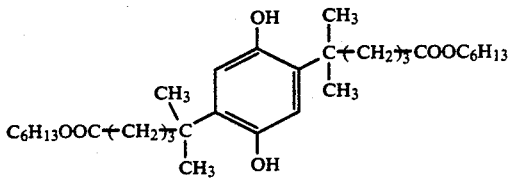

-continued
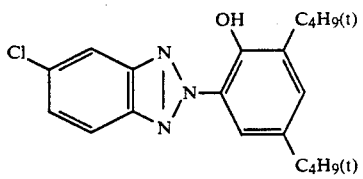
Cpd-6
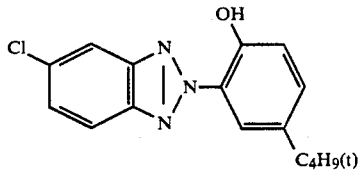
Cpd-7
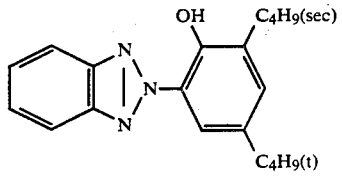
Cpd-8
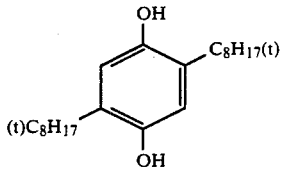
Cpd-9
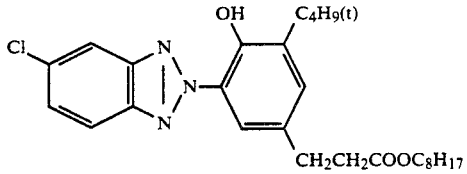
Cpd-10
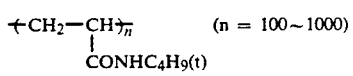
Cpd-11
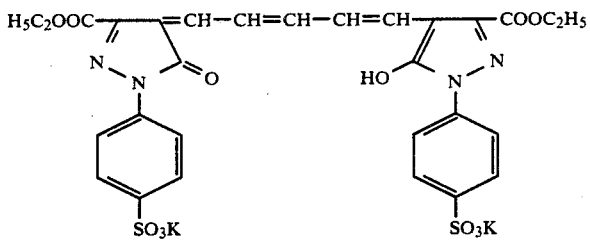
Cpd-12
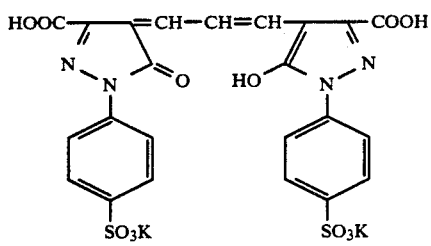
Cpd-13
| | |
|---|---|
| Dibutyl phthalate | Solv 1 |
| Trioctyl phosphate | Solv 2 |
| Trinonyl phosphate | Solv 3 |
| Tricresyl phosphate | Solv 4 |
The coating amount in terms of silver ($g/m^2$) of each layer was changed as follows:

| | | | | | |
|---|---|---|---|---|---|
| First Layer | EM7 | 0.18 | 0.15 | 0.12 | 0.11 |
| | EM8 | 0.18 | 0.15 | 0.12 | 0.11 |
| Third Layer | EM9 | 0.12 | 0.12 | 0.12 | 0.11 |
| | EM10 | 0.24 | 0.24 | 0.20 | 0.19 |
| Fifth Layer | EM11 | 0.09 | 0.07 | 0.07 | 0.05 |
| | EM12 | 0.12 | 0.16 | 0.16 | 0.12 |
| Summary | | 0.97 | 0.89 | 0.79 | 0.69 |

The above-described photographic materials A, B, C, and D were subjected to an imagewise light exposure, and then to continuous processing (running test) using a paper-processor in the following processing process, until the replenisher-amount of the developing solution equaled twice the volume of the color-developing tank. Two types of color-developer of the composition described below (CD-1 and CD-2) were used.

| Processing step | Temperature (°C.) | Time (sec.) | Replenisher Amount (ml)* | Tank (l) |
|---|---|---|---|---|
| Color-developing | 38 | 60 | 35 | 4 |
| Bleach-fixing | 30–36 | 45 | 215 | 4 |
| Stabilizing (1) | 30–37 | 20 | — | 2 |
| Stabilizing (2) | 30–37 | 20 | — | 2 |
| Stabilizing (3) | 30–37 | 20 | — | 2 |
| Stabilizing (4) | 30–37 | 20 | 200 | 4 |
| Drying | 70–80 | 60 | | |

*Replenisher amount per $m^2$ of photographic material (Rinsing steps were carried out in a four-tank cascade mode from tank of stabilizing (4) toward tank of stabilizing (1).)

The composition of the processing solutions were as follows:

| Color-Developing Solution (CD-1) | Tank solution | Replenisher |
|---|---|---|
| Water | 800 ml | 800 ml |
| Benzyl alcohol | 14.0 ml | 50.0 ml |
| Ethylenediaminetetraacetate | 5.0 g | 5.0 g |
| 5,6-Dihydroxybenzene-1,2,4-trisulfonate | 0.3 g | 0.3 g |
| Triethanoleamine | 8.0 g | 8.0 g |
| Sodium chloride | 8.4 g | 0.0 g |
| Potassium carbonate | 25 g | 25 g |
| N-Ethyl-N-(β-methanesulfonamidomethyl)-3-methyl-4-aminoaniline sulfate | 5.0 g | 15.0 g |
| Diethylhydroxylamine | 4.2 g | 10.0 g |
| Fluorescent brightening agent (4,4-diaminostilbene series) | 2.0 g | 5.0 g |
| Water to make | 1000 ml | 1000 ml |
| pH (25° C.) | 10.05 | 11.00 |

CD-2 was the same as CD-1, except that benzyl alcohol was excluded.

| Bleach-Fixing Solution (both the tank solution and replenisher are the same) | |
|---|---|
| Water | 400 ml |
| Ammonium thiosulfate (70%) | 100 ml |
| Sodium sulfite | 17 g |
| Iron (III) ammonium ethylenediamine-tetraacetate | 55 g |
| Disodium ethylenediaminetetraacetate | 5 g |
| Ammonium bromide | 40 g |
| Glacial acetic acid | 9 g |
| Water to make | 1000 ml |
| pH (25° C.) | 5.40 |

-continued

| Stabilizing Solution (both the tank solution and replenisher are the same) | |
|---|---|
| Formalin (37%) | 0.1 g |
| Formalin-sulfic acid adduct | 0.7 g |
| 5-Chloro-2-methyl-4-isothiazoline-3-on | 0.02 g |
| 2-Methyl-4-isothiazoline-3-on | 0.01 g |
| Copper sulfate | 0.005 g |
| Aqueous ammonia (28%) | 2.0 ml |
| Water to make | 1000 ml |
| pH (25° C.) | 4.0 |

As in Example 1, changes of Dmax, Dmin, and sensitivity and the existence of suspended matter after running process were tested and the results are shown in Table 4.

TABLE 4

| Processing Process | (1) | (2) | (3) | (4) | (5) | (6) | (7) | (8) |
|---|---|---|---|---|---|---|---|---|
| Developer | CD-1 | CD-1 | CD-1 | CD-1 | CD-2 | CD-2 | CD-2 | CD-2 |
| Photographic Material | A | B | C | D | A | B | C | D |
| Remarks | Comparative Example | | | | This Invention | | | |
| BL $\Delta D_{max}$ | +0.41 | +0.29 | +0.25 | +0.20 | +0.09 | +0.08 | +0.05 | +0.04 |
| BL $\Delta D_{max}$ | −0.29 | −0.21 | −0.19 | −0.19 | −0.12 | −0.11 | −0.05 | −0.04 |
| BL ΔSensitivity | −0.18 | −0.10 | −0.08 | −0.09 | −0.03 | −0.02 | −0.01 | −0.01 |
| Suspended Matter | XX | XX | XX | XX | Δ | Δ | ○ | ○ |

Note: Evaluation of suspended matter: ○ . . . None Δ . . . Found a little XX . . . Found many As is apparent from the results in Table 4, when a running process was carried out using a color-developer (CD-1) containing benzyl alcohol, as in processing processes (1) to (4), there were great changes in the photographic characteristics, especially in maximum density (Dmax), from the beginning to the end of running process, and a large amount of suspended matter, which seemed to be eluted silver from the photographic material, was observed in the color-developer after the running process.

However, when the running process was carried out using a color-developer (CD-2) not containing benzyl alcohol according to the present invention, as in processing processes (5) to (8), the changes in the photographic characteristics during the running process decreased, and practically no suspended matter, as described above, appeared after the running process. As such conditions were much improved, compared to those of processing processes (1) to (4). It is understood that the coating amount of photographic material in terms of silver is particularly preferably 0.80 g/$m^2$ or less in the present invention, since the changes in maximum density were smaller and the above-described suspended matter did not appear at all after processing processes (7) and (8).

Example 6

When a process was repeated in the same manner as in the processing processes (5) to (8) in Example 5, except that the stabilizer I-45 of the photographic materials A to D was changed to I-46 and I-47, respectively, the same preferable results were obtained.

Example 7

When a running test was repeated in the same manner as in the processing processes (5) to (8) in Example 5, except that diethylenehydroxylamine in CD-2 of color developer was changed to equal mol of II-2, III-1, IV-15, IV-19, IV-21, V-5, VI-1 and VII-5, respectively, the same preferable results were obtained.

Example 8

When a process was repeated in the same manner as in the processing processes (5) to (8) in Example 5, except that triethanolamine in CD-2 of color developer was changed to VII-1, IX-5, IX-8, X-1, X-3, XI-1, XI-3, XII-1, XII-2, XIII-2, XIII-10, XIV-8, XV-1, XVI-6 and XVII-1, respectively, the same preferable results were obtained.

Example 9

A multilayer color photographic paper was prepared with layers as hereinbelow described on a paper laminated on both sides with polyethylene. Coating solutions were prepared as follows:

Preparation of the first-layer coating solution

To a mixture of 19.1 g of yellow coupler (ExY). 4.4 g of an image-dye stabilizer (Cpd-1) and 0.7 g of an image-dye stabilizer (Cpd-7). 27.2 ml of ethyl acetate and 8.2 g of a solvent (Solv-3) were added and dissolved. The resulting solution was emulsified and dispersed in 185 ml of 10% aqueous gelatin solution containing 8 ml of a 10% solution of sodium dodecylbenzenesulfonate.

On the other hand, to a silver chlorobromide emulsion (cubic grain, av. grain size: 0.88 μm, deviation coefficient of grain size distribution: 0.08, silver bromide contained on the grain surface: 0.2 mol %) the following blue-sensitive sensitizing dye was added in an amount of $2.0\times10^{-4}$ mol per mol of silver, after which sulfur sensitization was carried out. The above-obtained emulsified and dispersed solution and this emulsion were mixed and dissolved to obtain the composition shown below, thereby preparing the first-layer coating solution. The second- to the seventh-layer coating solutions were prepared in the same manner as the first-layer coating solution. As a gelatin hardener for the respective layers, the sodium salt of 1-oxy-3,5-dichloro-2-triazine was used.

As the spectral sensitizing dye of each layer the following compounds were used.

Blue-sensitive emulsion layer

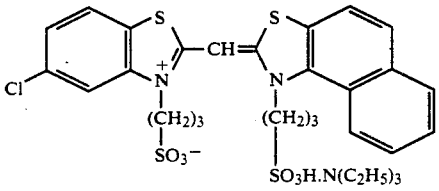

and

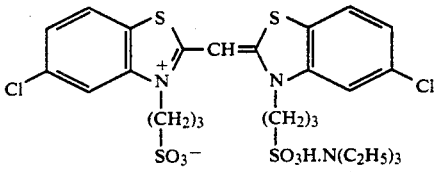

each $2.0\times10^{-4}$ mol per mol of silver halide)

Green-sensitive emulsion layer

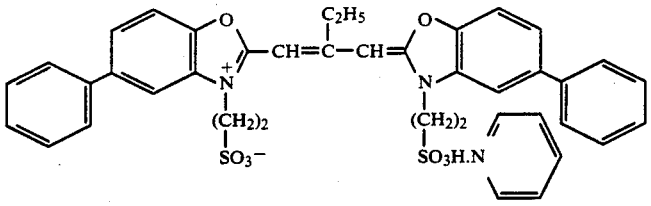

($4.0\times10^{-4}$ mol per mol of silver halide)

and

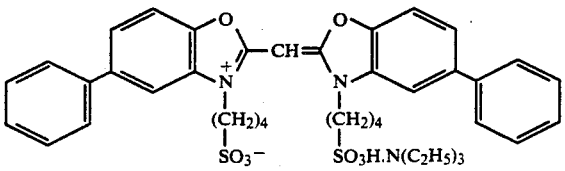

($7.0\times10^{-5}$ mol per mol of silver halide)

-continued

Red-sesitive emulsion layer

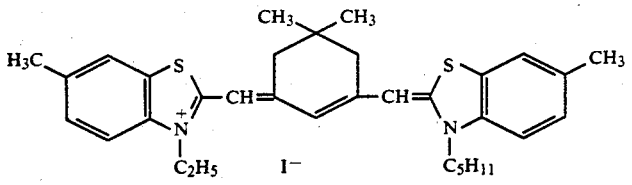

(0.9 × $10^{-4}$ mol per mol of silver halide)

The following compound was added to the red-sensitive layer in an amount of $2.6\times10^{-3}$ mol per mol of silver halide.

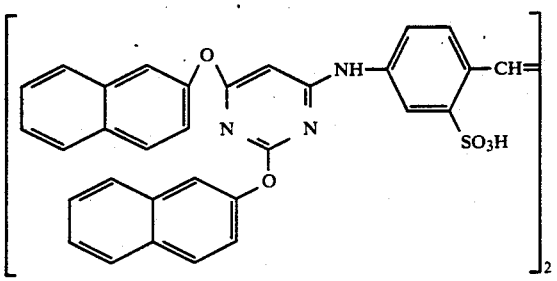

Further, to the blue-, green-, and red-sensitive layers 1-(5-methylureidophenyl)-5-mercaptotetrazole was added in an amount of $8.5\times10^{-5}$ mol, $7.7\times10^{-4}$ mol, and $2.5\times10^{-4}$ mol, respectively, per mol of silver halide.

The following dyes were added to each emulsion layer for preventing irradiation.

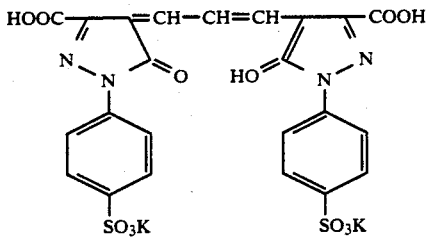

and

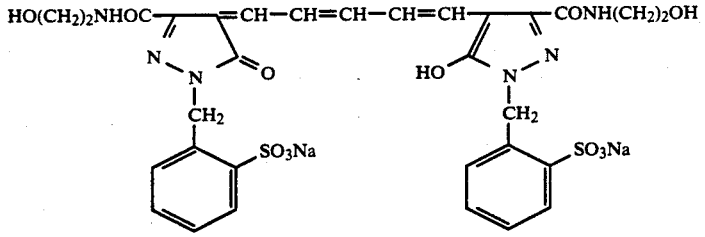

Compositions of layers

The composition of each layer is shown below. Each ingredient is indicated in g/m² of a coating amount, but the coating amount of silver halide is shown in g/m² in terms of silver.

Supporting base

Polyethylene-laminated paper (a white pigment, $TiO_2$, and a bluish dye, ultramarine, were included in the first-layer side of the polyethylene laminated)

| | |
|---|---|
| First layer: Blue-sensitive layer | |
| Silver bromide emulsion | 0.30 |
| Gelatin | 1.86 |
| Yellow coupler (ExY) | 0.82 |
| Image-dye stabilizer (Cpd-1) | 0.19 |
| Solvent (Solv-3) | 0.35 |
| Image-dye stabilizer (Cpd-7) | 0.06 |
| Second layer: Color-mix-preventing layer | |
| Gelatin | 0.99 |
| Color-mix inhibitor (Cpd-5) | 0.08 |
| Solvent (Solv-1) | 0.16 |
| Solvent (Solv-4) | 0.08 |
| Third layer: Green-sensitive emulsion layer | |
| Silver bromide emulsion (blend of cubic grains having av. grain size of 0.55 μm and 0.39 μm in Ag mol ratio of 1:3, each deviation coefficient of grain size distribution 0.10 and 0.08, AgBr contained on the grain surface: 0.8 mol %) | 0.12 |
| Gelatin | 1.24 |
| Magenta coupler (ExM) | 0.27 |
| Image-dye stabilizer (Cpd-3) | 0.15 |
| Image-dye stabilizer (Cpd-8) | 0.02 |
| Image-dye stabilizer (Cpd-9) | 0.03 |
| Solvent (Solv-2) | 0.54 |
| Fourth layer: UV-absorbing layer | |
| Gelatin | 1.58 |
| UV-absorbent (UV-1) | 0.47 |
| Color-mix inhibitor (Cpd-5) | 0.05 |
| Solvent (Solv-5) | 0.24 |
| Fifth layer: Red-sensitive emulsion layer | |

-continued

| | |
|---|---|
| Silver bromide emulsion (blend of cubic grains having av. grain size of 0.58 μm and 0.45 μm in Ag mol ratio of 1:4, each deviation coefficient of grain size distribution 0.09 and 0.11, AgBr contained on the grain surface: 0.6 mol %) | 0.23 |
| Gelatin | 1.34 |
| Cyan coupler (ExC) | 0.32 |
| Image-dye stabilizer (Cpd-6) | 0.17 |
| Image-dye stabilizer (Cpd-10) | 0.04 |
| Image-dye stabilizer (Cpd-7) | 0.40 |
| Solvent (Solv-6) | 0.15 |
| Sixth layer: UV-absorbing layer | |
| Gelatin | 0.53 |
| UV-absorbent (UV-1) | 0.16 |
| Color-mix inhibitor (Cpd-5) | 0.02 |
| Solvent (Solv-5) | 0.08 |
| Seventh layer: Protective layer | |
| Gelatin | 1.33 |
| Acryl-modified copolymer of poly (vinyl alcohol) (modification degree: 17%) | 0.17 |
| Liquid paraffin | 0.03 |

(ExY) Yellow coupler: the same as in Example 1

(ExM) Magenta coupler

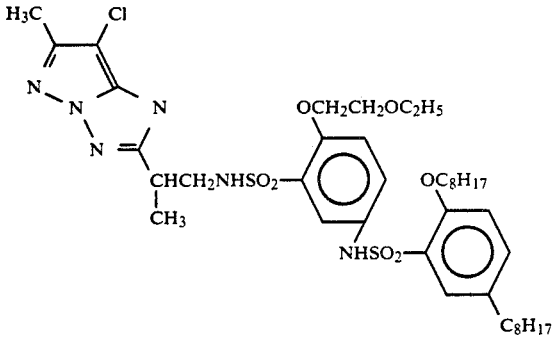

(ExC) Cyan coupler

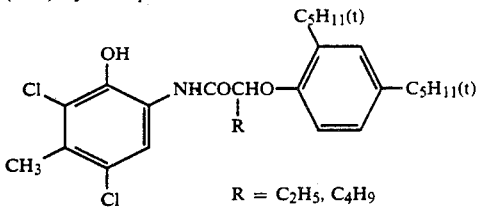

R = $C_2H_5$, $C_4H_9$

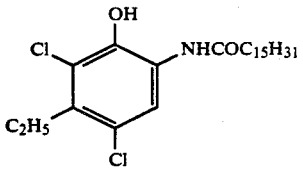

(blend of 2:4:4 in weight ratio)

(Cpd-1) Image-dye stabilizer: the same as in Example 1

(Cpd-3) Image-dye stabilizer: the same as in Example 1

(Cpd-5) Color-mix inhibitor: the same as in Example 1

(Cpd-6) Image-dye stabilizer

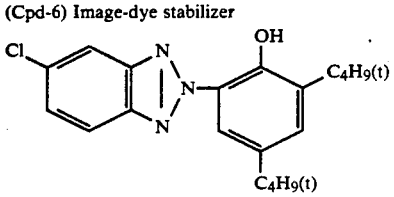

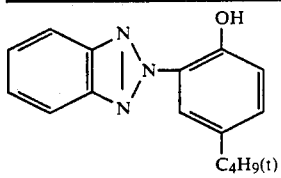

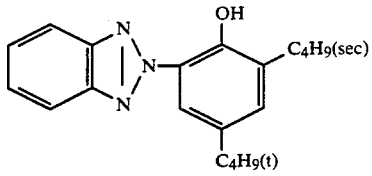

(blend of 2:4:4 in weight ratio)

(Cpd-7) Image-dye stabilizer

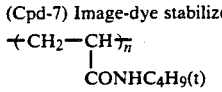

(av. molecular weight: 60,000)

(Cpd-8) Image-dye stabilizer

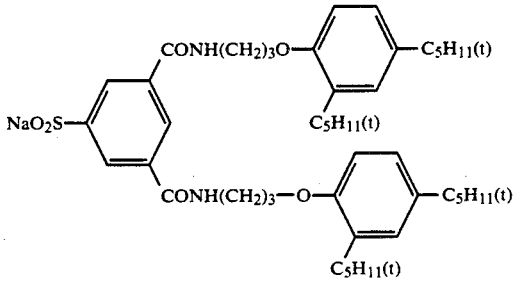

(Cpd-9) Image-dye stabilizer

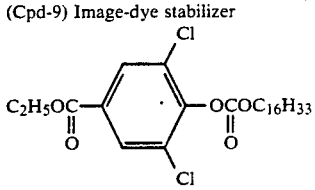

(Cpd-10) Image-dye stabilizer

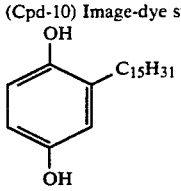

(UV-1) UV-Absorbe (blend of 4:2:4 in weight ratio)

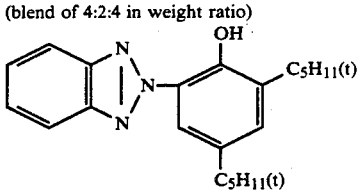

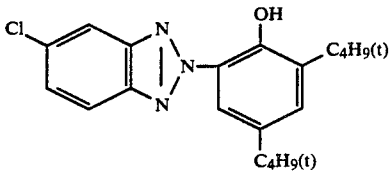

-continued

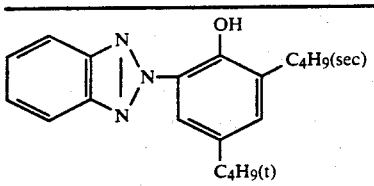

(Solv-1) Solvent: the same as in Example 1
(Solv-2) Solvent $O{=}P{-}(OCH_2CH(C_2H_5)C_4H_9)_3$,

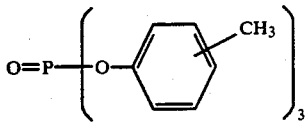

(blend of 2:1 in weight ratio)

(Solv-3) Solvent: the same as in Example 1
(Solv-4) Solvent: the same as in Example 1
(Solv-5) Solvent $(COOC_8H_{17})_2(CH_2)_8$ (Solv-6) Solvent

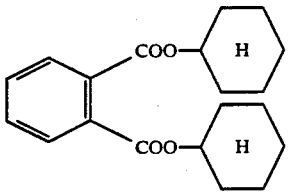

The thus-prepared sample is referred to as Sample O. Next, Samples P to S were prepared in the same manner except that the silver coating amount of each layer was changed as shown in Table 5. Then, Samples T to X were prepared by changing the stabilizer I-45 to A-1.

TABLE 5

| Sample | Coating amount of silver ($g/m^2$) B | G | R | Total |
|---|---|---|---|---|
| O/T | 0.30 | 0.12 | 0.23 | 0.65 |
| P/U | 0.32 | 0.18 | 0.25 | 0.75 |
| Q/V | 0.34 | 0.19 | 0.27 | 0.80 |
| R/W | 0.37 | 0.22 | 0.31 | 0.90 |
| S/T | 0.40 | 0.25 | 0.35 | 1.00 |

The above-described Samples O to X were subjected to an imagewise light exposure, and then to continuous processing (running test) using a paper-processor in the following processing process, until the replenisher-amount the color developer equaled twice the volume of the color developer tank.

| Processing step | Temperature (°C.) | Time (sec.) | Replenisher Amount* (ml) | Tank Volume (l) |
|---|---|---|---|---|
| Color-developing | 38 | 45 | See Table 6 | 4 |
| Bleach-fixing | 30~36 | 45 | 61 | 4 |
| Water-washing 1 | 30~37 | 30 | — | 2 |
| Water-washing 2 | 30~37 | 30 | — | 2 |
| Water-washing 3 | 30~37 | 20 | — | 2 |
| Drying | 70~85 | 60 | | |

*Replenisher amount per $m^2$ of photographic material (Water-washing steps were carried out in a three-tank caskade mode from tank of washing 3 toward tank of washing 1. Water from water-washing 1 was replenished to bleach-fixing step in an amount of 122 ml per square meter of photographic material.)

The composition of the processing solutions were as follows:

| Color Developer | (Tank solution) |
|---|---|
| Water | 800 ml |
| Ethylenediamine-N,N,N,'N'-tetramethylenephosphonate | 3.0 g |
| Triethanolamine | 8.0 g |
| Sodium chloride | See Table 6 |
| Potassium bromide | See Table 6 |
| Potassium carbonate | 25 g |
| N-Ethyl-N-(β-methanesulfonamidoethyl)-3-methyl-4-aminoaniline sulfonate | 5.0 g |
| Organic preservative A (IV-19) | 0.03 mol |
| Fluorescent brightening agent (WHITEX, made by Sumitomo Chemical Co.) | 1.0 g |
| Water to make | 1000 ml |
| pH (25° C.) | 10.05 |

| Replenisher | [Replenisher] ⓐ | ⓑ | ⓒ | ⓓ |
|---|---|---|---|---|
| Phophonate* (g/l) | 3 | 3 | 3 | 5 |
| Triethanolamine (g/l) | 12 | 12 | 12 | 12 |
| Potassium chloride | | See Table 6 | | |
| Potassium bromide | | See Table 6 | | |
| Potassium carbonate (g/l) | 26 | 26 | 26 | 26 |
| Sulfate** (g/l) | 6 | 7 | 9 | 11 |
| Or. Preserv. (IV-19) (g/l) | 6 | 6 | 7 | 9 |
| WHITEX*** (g/l) | 1.5 | 2 | 2.5 | 3 |
| pH | 10.35 | 10.45 | 10.55 | 10.65 |

| Bleach-fixing Solution | (Tank Solution) |
|---|---|
| Water | 400 ml |
| Ammonium thiosulfate (70%) | 100 ml |
| Ammonium sulfite | 38 g |
| Iron (III) ammonium ethylenediamine-tetraacetate | 55 g |
| Disodium ethylenediaminetetraacetate | 5 g |
| Glacial acetic acid | 9 g |
| Water to make | 1000 ml |
| pH (25° C.) | 5.40 |
| Washing Water | |
| (Both the tank solution and replenisher are the same) Ion-exchanged water (each content of calsium and magnesium was 3 ppm or less) | |

*Ethylenediamine-N,N,N,'N'-tetramethylene phosphonate
**N-Ethyl-N-(3-methanesulfonamidoethyl)-3-methyl-4-aminoaniline sulfonate
***Fluorescent brightening agent, made by Sumitomo Chemical Co.)

To each of color developer, bleach-fixing solution, and washing water distilled water was added in an amount respectively corresponding to vaporized water to compensate the condensation due to vaporation at the continuous processing.

The above-described coated samples were subjected to a gradational exposure of light for a sensitometry using a sensitometer (FWH-type, made by Fuji Photo Film CO., Ltd., color temperature at light source: 3200K). The exposure was conducted to give an exposure time of one tenth second and an exposure amount of 250 CMS.

At the beginning and the end of the running test, each samples was subjected to the above-described sensitometry, and then the minimum densities (Dmin) of blue (B), and the sensitivity (log E at density 0.5) were determined by using a Macbeth densitometer. The results are shown in Table 6. In the Table, + represents the increase of sensitibity and − represents the decrease of sensitivity.

At the same time, the existence of suspended matters in the color developer after the running test was evaluated by visual inspection. The results are shown in Table 6.

However, when the compound represented by formula (1) of the present invention and the developer of the present invention were not used, as shown in processing processes to , it was found that by reducing the replenisher amount remarkably the purpose of the present invention could not be attained because there were great changes in the minimum density and in sensitivity during the running and large amount of suspended matter occurred.

TABLE 6

| Processing Process | | 1 | 2 | 3 | 4 | 5 | 6 | 7 | 8 |
|---|---|---|---|---|---|---|---|---|---|
| Coated Sample | | O | P | Q | R | S | T | O | O |
| Stabilizer | | I-45 | I-45 | I-45 | I-45 | I-45 | A-1 | I-45 | I-45 |
| Coating Amount of Silver (g/m²) | | 0.65 | 0.75 | 0.80 | 0.90 | 1.00 | 0.65 | 0.65 | 0.65 |
| Benzyl Alcohol (ml/l) | | — | — | — | — | — | — | — | — |
| Tank Solution/Replenisher | | | | | | | | | |
| Replenisher/Amount (ml/m²) | | b/100 | b/100 | b/100 | b/100 | b/100 | b/100 | a/30 | c/200 |
| Chloride Ion Concentration of Developer (g/l) | Tank Solution | $7 \times 10^{-2}$ | $7 \times 10^{-2}$ | $7 \times 10^{-2}$ | $7 \times 10^{-2}$ | $7 \times 10^{-2}$ | $7 \times 10^{-2}$ | $1.2 \times 10^{-1}$ | $6 \times 10^{-2}$ |
| | Replenisher | $2.7 \times 10^{-2}$ | $2.5 \times 10^{-2}$ | $2.2 \times 10^{-2}$ | $2.0 \times 10^{-2}$ | $1.7 \times 10^{-2}$ | $2.7 \times 10^{-2}$ | — | $1.7 \times 10^{-2}$ |
| Bromide Ion Concentration of Developer (g/l) | Tank Solution | $2.5 \times 10^{-4}$ | $2.5 \times 10^{-4}$ | $2.5 \times 10^{-4}$ | $2.5 \times 10^{-4}$ | $2.5 \times 10^{-4}$ | $2.5 \times 10^{-4}$ | $4.0 \times 10^{-4}$ | $2 \times 10^{-4}$ |
| | Replenisher | $1.3 \times 10^{-4}$ | $1.0 \times 10^{-4}$ | $0.6 \times 10^{-4}$ | $0.3 \times 10^{-4}$ | — | $1.3 \times 10^{-4}$ | — | $1.4 \times 10^{-4}$ |
| Remark | | This Invention | This Invention | This Invention | This Invention | This Invention | Comparative Example | This Invention | Comparative Example |
| BL ΔDmin | | ±0.0 | +0.01 | +0.01 | +0.02 | +0.02 | +0.09 | +0.02 | +0.01 |
| BL ΔSensitibity | | ±0.0 | −0.01 | −0.02 | −0.03 | −0.03 | −0.06 | −0.01 | −0.02 |
| Suspended Matter | | ○ | ○ | ○ | Δ | Δ | XX | ○ | ○ |

| Processing Process | | 9 | 10 | 11 | 12 | 13 | 14 | 15 | 16 |
|---|---|---|---|---|---|---|---|---|---|
| Coated Sample | | O | T | T | T | O | O | O | O |
| Stabilizer | | I-45 | A-1 | A-1 | A-1 | A-1 | I-45 | I-45 | I-45 |
| Coating Amount of Silver (g/m²) | | 0.65 | 0.65 | 0.65 | 0.65 | 0.65 | 0.65 | 0.65 | 0.65 |
| Benzyl Alcohol (ml/l) | | — | 14/40 | 14/33 | 14/28 | 14/20 | — | — | — |
| Tank Solution/Replenisher | | | | | | | | | |
| Replenisher/Amount (ml/m²) | | d/300 | a/30 | b/100 | c/200 | d/300 | 100 | 100 | 100 |
| Chloride Ion Concentration of Developer (g/l) | Tank Solution | $3.6 \times 10^{-2}$ | $1.2 \times 10^{-1}$ | $7 \times 10^{-2}$ | $6 \times 10^{-2}$ | $3.6 \times 10^{-2}$ | $4.3 \times 10^{-2}$ | $5.4 \times 10^{-2}$ | $5.4 \times 10^{-2}$ |
| | Replenisher | $2.2 \times 10^{-2}$ | — | $2.7 \times 10^{-2}$ | $1.7 \times 10^{-2}$ | $2.2 \times 10^{-2}$ | — | $1.6 \times 10^{-2}$ | $1.6 \times 10^{-2}$ |
| Bromide Ion Concentration of Developer (g/l) | Tank Solution | $4.0 \times 10^{-5}$ | $4.0 \times 10^{-4}$ | $2.5 \times 10^{-4}$ | $2 \times 10^{-4}$ | $4.0 \times 10^{-5}$ | $1.2 \times 10^{-4}$ | $1.7 \times 10^{-3}$ | $5.9 \times 10^{-3}$ |
| | Replenisher | $2.0 \times 10^{-5}$ | — | $1.3 \times 10^{-4}$ | $1.4 \times 10^{-4}$ | $2.0 \times 10^{-5}$ | — | $1.6 \times 10^{-3}$ | $5.8 \times 10^{-3}$ |
| Remark | | Comparative Example | Comparative Example | Comparative Example | Comparative Example | Comparative Example | This Invention | This Invention | This Invention |
| BL ΔDmin | | +0.01 | +0.16 | +0.09 | +0.04 | +0.03 | ±0.0 | +0.01 | +0.01 |
| BL ΔSensitibity | | −0.01 | −0.11 | −0.05 | −0.03 | −0.02 | ±0.0 | −0.03 | −0.04 |
| Suspended Matter | | ○ | XX | XX | Δ | Δ | ○ | Δ | Δ |

Evaluation of Suspended Matter:
○ — None
Δ — Found a little
X — Found
XX — Found many
Note:

(A-1)

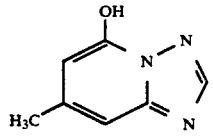

As is apparent from the results in Table 6, according to the process of the present invention in which a compound represented by formula (I) of the present invention was employed using a color developer not containing benzyl alcohol as shown in processing processes 1 and 7 to 9, even if the reprenishing amount was remarkably reduced, there were attained good results that the changes in minimum density and in sensitivity were little in the running and that the occurrence of suspended matter was effectively prevented.

Also, in the case of the processing processes 8, 9, , and , the purpose of the present invention could not be attained because of the large replenishing amount while the change of photographic properties and the occurrence of suspended matter were little.

It is apparent that, as shown in processing processes 1 to 5, the coating amount of silver in the photographic material of the present invention is preferably 0.8 g/m², more preferably 075 g/m² or below, in particular preferably 0.65 g/m² or below, from the standpoint preventing the change of photographic properties and occurrence of suspended matter.

Further more, it is apparent that, as shown in processing processes ⑭ to ⑯, it is more preferable that chloride ion and bromide ion in the developer of the present invention are contained in the range of $3.5\times10^{-2}$ to $1.5\times10^{-1}$ mol, and $3.0\times10^{-5}$ to $1.0\times10^{-3}$ mol, respectively, from the standpoint of preventing the change of sensitivity and occurrence of suspended matter due to the long running.

Having described our invention as related to the embodiment, it is our intention that the invention be not limited by any of the details of the description, unless otherwise specified, but rather be construed broadly within its spirit and scope as set out in the accompanying claims.

What we claim is:

1. A method of continuously processing a silver halide color photographic material with a color developer containing at least one aromatic primary amine color-developing agent, which comprises developing, after exposure to light, a silver halide color photographic material having a total coating amount of silver halide in terms of silver of from 0.40 to 0.70 g/m$^2$ and at least one of the layers of which contains a silver halide emulsion containing at least 80 mol % silver chloride in the presence of a compound represented by the following formula (I):

$$Z—S—M \qquad (I)$$

wherein M represents a hydrogen atom, a cation, or —S—Z, in which Z represents a heterocyclic residue containing one or more nitrogen atoms, with a color developer that is substantially free from sulfite ion and benzyl alcohol and whose replenishing amount is 20 ml to 120 ml per m$^2$ of the silver halide photographic material.

2. The method as claimed in claim 1, wherein the color developer contains both chloride ion in the range of $3.5\times10^{-2}$ to $1.5\times10^{-1}$ mol and bromide ion in the range of $3.0\times10^{-5}$ to $1.0\times10^{-3}$ mol, per liter of the color developer.

3. The method as claimed in claim 1, wherein the color developer is substantially free from hydroxylamine.

4. The method as claimed in claim 1, wherein the silver halide color photographic material has a total coating amount of silver halide in terms of silver of 0.40 to 0.65 g/m$^2$.

5. The method as claimed in claim 1, wherein the heterocyclic residue of the compound represented by formula (I) contains 2 to 4 nitrogen atoms.

6. The method as claimed in claim 1, wherein the compound represented by formula (I) is included in at least one of the layers of the silver halide color photographic material.

7. The method as claimed in claim 6, wherein the compound represented by formula (I) is contained in the range of $10^{-7}$ to $10^{-1}$ mol per mol of the silver halide in the layer of the silver halide photographic material.

8. The method as claimed in claim 1, wherein the compound represented by formula (I) is contained in the color developer.

9. The method as claimed in claim 8, wherein the compound represented by formula (I) is contained in the range of $10^{-10}$ to $10^{-3}$ mol per liter of the color developer.

10. The method as claimed in claim 1, wherein the color developer contains an organic preservative.

11. The method as claimed in claim 1, wherein the color developer contains at least one organic preservative selected from hydroxylamine derivatives, hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds, and condensed ring-type amines.

12. The method as claimed in claim 1, wherein the aromatic primary amine color developing agent is a p-phenylenediamine derivative.

13. The method as claimed in claim 1, wherein the color developer contains (i) at least one preservative selected from hydroxylamine derivatives, hydroxamic acids, hydrazines, hydrazides, phenols, α-hydroxyketones, α-aminoketones, saccharides and (ii) at least one preservative selected from monoamines, diamines, polyamines, quaternary ammonium salts, nitroxy radicals, alcohols, oximes, diamide compounds, and condensed ring-type amines.

14. The method as claimed in claim 1, wherein the color developer contains (i) at least one preservative selected from hydroxylamine derivatives represented by formula (II):

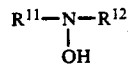

Formula (II)

wherein $R^{11}$ and $R^{12}$ each represent a hydrogen atom, a substituted or unsubstituted alkyl group, a substituted or unsubstituted alkenyl group, a substituted or unsubstituted aryl group, or a heteroaromatic group, they do not represent hydrogen atoms at the same time, and they may bond together to form a heterocyclic ring with the nitrogen atom, and hydrazines and hydrazides represented by formula (IV):

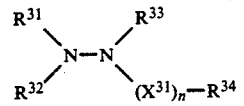

Formula (IV)

wherein $R^{31}$, $R^{32}$, and $R^{33}$ each independently represent a hydrogen atom, a substituted or unsubstituted alkyl group, a substituted or unsubstituted aryl group, or a substituted or unsubstituted heterocyclic group; $R^{34}$ represents a hydroxy group, a hydroxyamino group, a substituted or unsubstituted alkyl group, a substituted or unsubstituted heterocyclic group, a substituted or unsubstituted alkoxy group, a substituted or unsubstituted aryloxy group, a substituted or unsubstituted carbamoyl group, or a substituted or unsubstituted amino group, and (ii) at least one preservative selected from monoamines represented by formula (VIII):

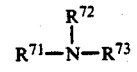

Formula (VIII)

wherein $R^{71}$, $R^{72}$, and $R^{73}$ each represent a hydrogen atom, an alkyl group, an alkenyl group, an aryl group, an aralkyl group or a heterocyclic group, and $R^{71}$ and $R^{72}$, $R^{71}$ and $R^{73}$, or $R^{72}$ and $R^{73}$ may bond together to form a nitrogen-containing heterocyclic group, and amines having a condensed ring represented by formula (XVII):

Formula (XVII)

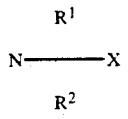

wherein X represents a trivalent group of atoms necessary to complete a condensed ring, and $R^1$ and $R^2$ each represent an alkylene group, an arylene group, an alkenylene group, or an aralkylene group, and $R^1$ and $R^2$ may be the same or different.

15. The method as claimed in claim 1, wherein the pH of the color developer is in the range of 9 to 12.

16. The method as claimed in claim 1, wherein the silver halide emulsion of the at least one of the layers contains 95 mol % or over of silver chloride.

* * * * *